US012054931B2

(12) United States Patent
Davies et al.

(10) Patent No.: US 12,054,931 B2
(45) Date of Patent: Aug. 6, 2024

(54) ANTI-SPLASH URINALS

(71) Applicants: Richard M. Davies, Charlotte, NC (US); Jerald Bradley, Charlotte, NC (US); Kevin W. Gemas, Thiensville, WI (US)

(72) Inventors: Richard M. Davies, Charlotte, NC (US); Jerald Bradley, Charlotte, NC (US); Kevin W. Gemas, Thiensville, WI (US)

( * ) Notice: Subject to any disclaimer, the term of this patent is extended or adjusted under 35 U.S.C. 154(b) by 0 days.

(21) Appl. No.: 17/588,881

(22) Filed: Jan. 31, 2022

(65) Prior Publication Data

US 2022/0243446 A1 Aug. 4, 2022

Related U.S. Application Data

(60) Provisional application No. 63/144,265, filed on Feb. 1, 2021.

(51) Int. Cl.
*E03D 13/00* (2006.01)

(52) U.S. Cl.
CPC ..... *E03D 13/005* (2013.01)

(58) Field of Classification Search
CPC ..... E03D 13/005; E03D 13/00
See application file for complete search history.

(56) References Cited

U.S. PATENT DOCUMENTS 2,817,846 A * 12/1957 Stift ..... B60R 15/00 4/301
D208,291 S 8/1967 McIntosh
D240,132 S 6/1976 Lofgren
D288,709 S 3/1987 Campbell
5,822,806 A * 10/1998 Kizhnerman ..... E03D 13/00 4/310
D420,730 S 2/2000 Thomas
6,470,504 B1 10/2002 Neuo
7,043,773 B2 5/2006 McAleenan
7,992,231 B1 8/2011 Schlicksup
8,856,978 B2 * 10/2014 Liebel ..... E03D 13/007 4/311
D904,585 S 12/2020 Wagner
(Continued)

FOREIGN PATENT DOCUMENTS

CN 2769388 Y 4/2006
CN 2898149 Y 5/2007
(Continued)

OTHER PUBLICATIONS

KR-200476429-Y1 Machine translation retrieved Mar. 4, 2023 (Year: 2023).*
(Continued)

*Primary Examiner* — Janie M Loeppke
(74) *Attorney, Agent, or Firm* — Myers Bigel, P.A.

(57) ABSTRACT

A urinal includes a rear wall having a concave inner surface extending downward toward a drain orifice, a pair of sidewalls extending outwardly from the rear wall inner surface in spaced apart relationship, and a user platform positioned between the sidewalls and elevated relative to the drain orifice. The sidewalls are configured such that, when a user is standing on the platform, the user is positioned between the sidewalls.

33 Claims, 23 Drawing Sheets

(56) References Cited

U.S. PATENT DOCUMENTS

| | | | | |
|---|---|---|---|---|
| 2010/0095445 | A1* | 4/2010 | Rice | E03D 13/00 4/301 |
| 2015/0275495 | A1* | 10/2015 | Tani | E03D 13/00 4/310 |
| 2016/0299061 | A1 | 10/2016 | Goldring et al. | |

FOREIGN PATENT DOCUMENTS

| | | | | |
|---|---|---|---|---|
| CN | 301022238 | S | 9/2009 | |
| CN | 301057796 | S | 11/2009 | |
| CN | 301057797 | S | 11/2009 | |
| CN | 301057798 | S | 11/2009 | |
| CN | 202658698 | U | 1/2013 | |
| CN | 103469879 | A | 12/2013 | |
| CN | 103981936 | B | 4/2016 | |
| CN | 304920735 | S | 11/2018 | |
| CN | 210684920 | U | 6/2020 | |
| DE | 19927160 | A1 | 1/2001 | |
| JP | 2017055782 | A | 3/2017 | |
| JP | 6428991 | B2 | 11/2018 | |
| KR | 19980013040 | U | 6/1998 | |
| KR | 100386377 | B1 | 6/2003 | |
| KR | 300451061 | S | 5/2007 | |
| KR | 300451062 | S | 5/2007 | |
| KR | 300454576 | S | 6/2007 | |
| KR | 300454577 | S | 6/2007 | |
| KR | 300454578 | S | 6/2007 | |
| KR | 20090046766 | A * | 5/2009 | |
| KR | 200448497 | Y1 | 4/2010 | |
| KR | 20100005031 | U | 5/2010 | |
| KR | 100999079 | B1 | 12/2010 | |
| KR | 101425525 | B1 | 8/2014 | |
| KR | 200476429 | Y1 * | 3/2015 | |
| KR | 100999079 | B1 * | 12/2017 | |
| TW | M390967 | U | 10/2010 | |
| WO | WO-2019137592 | A1 * | 7/2019 | E03D 13/00 |

OTHER PUBLICATIONS

KR-100999079-B1 Machine translation retrieved Mar. 4, 2023 (Year: 2023).*

KR-20090046766-A machine translation retrieved Mar. 4, 2023 (Year: 2023).*

"International Search Report and Written Opinion of the International Searching Authority", International Application No. PCT/US2022/014574, Apr. 19, 2022, 11 pp.

* cited by examiner

ANTI-SPLASH URINALS

RELATED APPLICATION

This application claims the benefit of and priority to U.S. Provisional Patent Application No. 63/144,265 filed Feb. 1, 2021, the disclosure of which is incorporated herein by reference as if set forth in its entirety.

FIELD OF THE INVENTION

The present invention relates generally to restroom fixtures and, more particularly, to urinals.

BACKGROUND OF THE INVENTION

A problem with conventional urinals is the tendency of urine to splash out of the urinal onto the floor and other exterior surfaces, and even onto the person using the urinal. As a result, maintaining clean, safe, and sanitary conditions in restrooms can be difficult, particularly in restrooms where concentrated usage occurs during short periods of time, such as sports arenas, schools, rest stops, etc.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

According to some embodiments of the present invention, a urinal includes a rear wall having a concave inner surface extending downward toward a basin having a drain orifice therein, a pair of sidewalls extending outwardly from the rear wall inner surface in spaced apart relationship, and a user platform positioned between the sidewalls and elevated relative to the drain orifice. The sidewalls are configured such that, when a user is standing on the platform, the user is positioned between the sidewalls. The rear wall, sidewalls, and user platform can be a monolithic structure of polymeric material, or can be separate components that are assembled.

According to some embodiments of the present invention, a urinal includes a rear wall having a concave inner surface extending downward toward a basin having a drain orifice therein, a pair of sidewalls extending outwardly from the rear wall inner surface in spaced apart relationship, and a user platform positioned between the sidewalls, wherein the platform is elevated relative to the drain orifice and angled downwardly toward the rear wall inner surface. The sidewalls have opposing concave inner surfaces and are configured such that, when a user is standing on the platform, the user is positioned between the sidewalls. The rear wall, sidewalls, and user platform can be a monolithic structure of polymeric material, or can be separate components that are assembled.

According to some embodiments of the present invention, a urinal includes a rear wall having a concave inner surface extending downward toward a basin having a drain orifice therein, a pair of sidewalls extending outwardly from the rear wall inner surface in spaced apart relationship, a substantially horizontal upper wall extending outwardly from the rear wall inner surface between upper end portions of the sidewalls, and a user platform positioned between the sidewalls and elevated relative to the drain orifice. The sidewalls are configured such that, when a user is standing on the platform, the user is positioned between the sidewalls. The rear wall, upper wall, sidewalls, and user platform can be a monolithic structure of polymeric material, or can be separate components that are assembled.

According to some embodiments of the present invention, a urinal includes a rear wall having a concave inner surface extending downward toward a basin having a drain orifice therein, a pair of sidewalls extending outwardly from the rear wall inner surface in spaced apart relationship, wherein the sidewalls have opposing concave inner surfaces, and a user platform positioned between the sidewalls, wherein the platform is elevated relative to the basin and angled downwardly toward the basin. The sidewalls are configured such that, when a user is standing on the platform, the user is positioned between the sidewalls. A user access ramp extends from the user platform to a surface on which the urinal is supported. The rear wall, sidewalls, user platform, and user access ramp can be a monolithic structure of polymeric material, or can be separate components that are assembled.

In some embodiments, the urinals described above may include a sensor configured to detect a user on the user platform. A water flush system is configured to supply water to flush the urinal in response to the sensor detecting the user on the user platform or detecting the user leaving the user platform.

In some embodiments, the urinals described above may include at least one light configured to illuminate an interior of the urinal. The at least one light may be configured to be activated in response to the sensor detecting a user on the user platform.

In some embodiments, the urinals described above may include a display configured to display information to a user. The display may be configured to be activated and to display information in response to the sensor detecting a user on the user platform.

According to some embodiments of the present invention, a restroom includes a plurality of urinals in adjacent relationship, wherein each urinal is a monolithic structure of polymeric material. In some embodiments, the plurality of urinals are in adjacent contacting relationship. Each urinal includes a rear wall having a concave inner surface extending downward toward a basin having a drain orifice therein, a pair of sidewalls extending outwardly from the rear wall inner surface in spaced apart relationship, wherein the sidewalls have opposing concave inner surfaces, and a user platform positioned between the sidewalls, wherein the platform is elevated relative to the basin and angled downwardly toward the basin. The sidewalls are configured such that, when a user is standing on the platform, the user is positioned between the sidewalls.

In some embodiments, at least one of the urinals includes a user access ramp extending from a respective user platform of the at least one urinal to a surface on which the at least one urinal is supported.

In some embodiments, at least one of the urinals includes a sensor configured to detect a user on a respective user platform of the at least one urinal, and at least one light configured to illuminate an interior of the at least one urinal. The at least one light is configured to be activated in response to the sensor detecting the user on the user platform.

In some embodiments, at least one of the urinals comprises a sensor configured to detect a user on a respective user platform of the at least one urinal. The at least one of the urinals includes a display that is configured to display information in response to the sensor detecting the user on the user platform.

Urinals according to embodiments of the present invention are advantageous over conventional urinals because the walk-in design is configured to reduce urine particle impact and contain all splash, droplets and spray produced when urinating. As such, urinals according to embodiments of the present invention can reduce or eliminate the spread of bioaerosols and plumes, can reduce odors, and can significantly reduce maintenance costs and improve overall hygiene within restrooms, as well as reduce the spread of bacteria and viruses. Moreover, urinals according to some embodiments of the present invention can have a modular structure that allows for a stackable side-by-side arrangement within a restroom. This modular structure eliminates the need to install side panels with added wall and floor tile between urinals, thereby saving installation costs in restrooms.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1A:
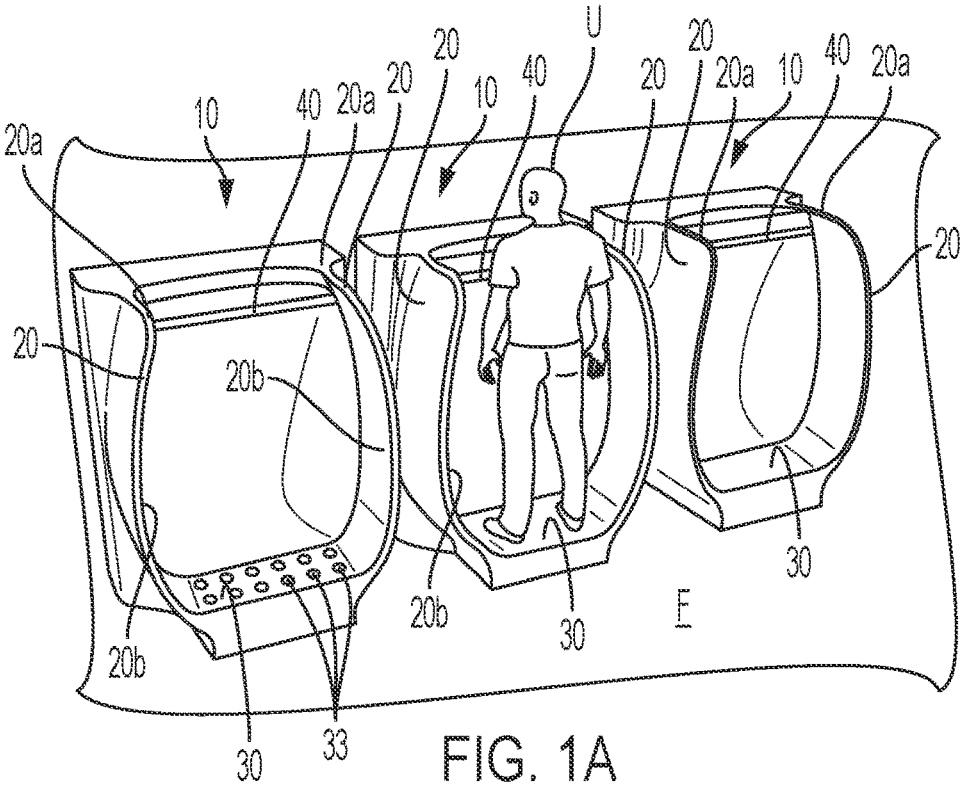
FIGS. 1A-1B are perspective views of a plurality of urinals, according to some embodiments of the present invention; the urinals are in a stackable side-by-side arrangement.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines illustrate optional features or operations unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

When an element is referred to as being "connected", "coupled", "responsive", or variants thereof to another element, it can be directly connected, coupled, or responsive to the other element or intervening elements may be present. In contrast, when an element is referred to as being "directly connected", "directly coupled", "directly responsive", or variants thereof to another element, there are no intervening elements present. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items.

As used herein, the terms "comprise", "comprising", "comprises", "include", "including", "includes", "have", "has", "having", or variants thereof are open-ended, and include one or more stated features, integers, elements, steps, components or functions but do not preclude the presence or addition of one or more other features, integers, elements, steps, components, functions or groups thereof. Furthermore, as used herein, the common abbreviation "e.g.," which derives from the Latin phrase "exempli gratia," may be used to introduce or specify a general example or examples of a previously mentioned item, and is not intended to be limiting of such item. The common abbreviation "i.e.," which derives from the Latin phrase "id est," may be used to specify a particular item from a more general recitation.

It will be understood that although the terms first, second, third, etc., may be used herein to describe various elements/operations, these elements/operations should not be limited by these terms. These terms are only used to distinguish one element/operation from another element/operation. Thus, a first element/operation in some embodiments could be termed a second element/operation in other embodiments without departing from the teachings of present inventive concepts. The same reference numerals or the same reference designators denote the same or similar elements throughout the specification.

The terms "about" and "approximately", as used herein with respect to a value or number, means that the value or number can vary by +/− twenty percent (20%).

Figure 1B:
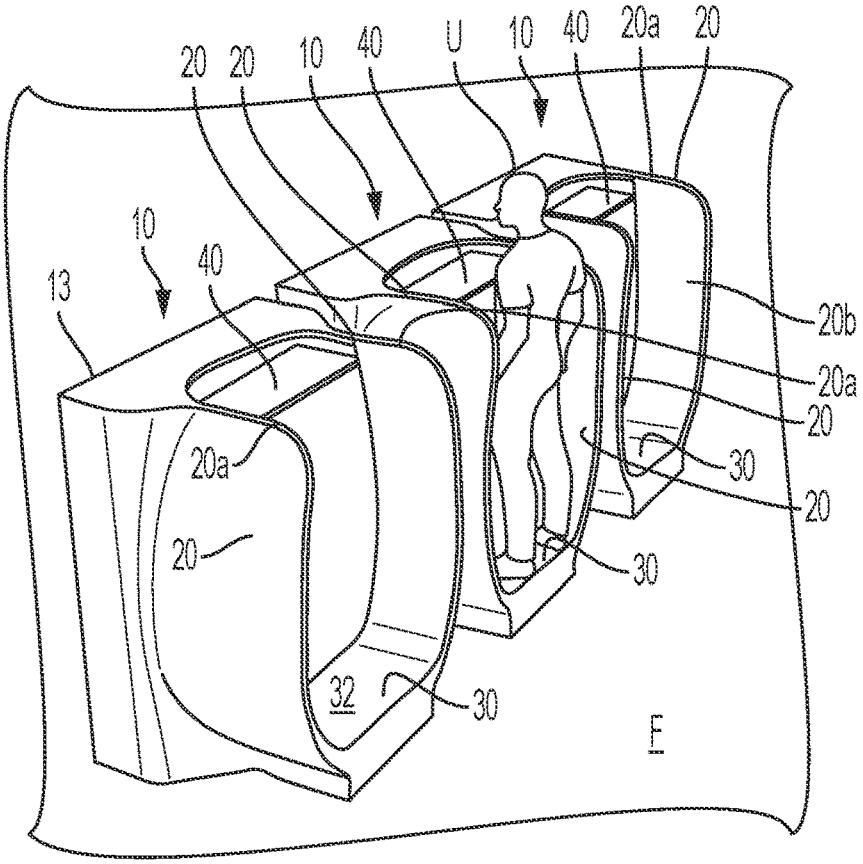

Referring initially to FIGS. 1A-1B, a group of urinals 10 according to some embodiments of the present invention are illustrated. Each urinal 10 has a "walk-in" structure that serves as a personal stall. The walk-in structure includes various surface angles and curves that direct urine away from a user's body and thus significantly reduces splash back. In addition, the urinals 10 have a configuration that allows them to be installed in a side-by-side configuration within a restroom. In some embodiments, the urinal 10 may be modular in that it is formed as a monolithic structure from one or more types of materials, such as polymeric material. In some embodiments, the monolithic structure is formed from a light weight, high strength and durable polymeric material, such as, but not limited to, polypropylene, high density polyethylene, low density polyethylene, polyethylene terephthalate, etc.

The modular configuration of the urinal 10 facilitates installation of multiple urinals 10 in that they may be arranged in adjacent, side-by-side configuration, including adjacent contacting relationship. In addition, the light weight, modular urinal configuration can reduce shipping costs, and can simplify handling and installation, thereby reducing installation costs.

Each illustrated urinal 10 includes a rear wall 12 having a concave inner surface 14 extending downward toward a drain orifice 16 (FIGS. 4A-4C) that is positioned at the lowest portion of the rear wall 12 and that forms a basin B. The drain orifice 16 is configured to be in fluid communication with a sanitary drain line and waste trap arrangement, as would be understood by one skilled in the art. The rear wall 12 can have a substantially planar rear surface 13 that is configured to be positioned against a wall of a restroom. However, the rear surface 13 can have virtually any shape or configuration in order to conform to the shape/configuration of a restroom wall. Moreover, the urinal 10 can be configured such that the rear wall 12 is set within a wall of a restroom.

A pair of sidewalls 20 extend outwardly from the rear wall inner surface 14 in spaced apart relationship, and a user platform 30 is positioned between the sidewalls 20. The platform 30 is elevated relative to the lower portion of the rear wall inner surface 14 that contains the drain orifice 16, as illustrated in FIGS. 4A-4C. The sidewalls 20 are configured such that, when a user U is standing on the platform 30, the user U is positioned substantially entirely between the sidewalls 20 (FIGS. 3A-3B). As such, the modular urinal 10 of the present invention is effectively a walk-in stall, and a user is effectively "enclosed" within the stall during use. In other words, the user's body in combination with the sidewalls 20 and rear wall define an enclosure that effectively reduces the possibility of urine from splashing outwardly onto the floor of a restroom. However, embodiments of the present invention do not require that a user be positioned entirely between the sidewalls 20. For example, a portion of a user's body may extend slightly outwardly from the front edges of the sidewalls 20.

In the illustrated embodiment of FIGS. 1A-1B, the urinals 10 are illustrated being supported on a floor F of a restroom. However, in some installations, a urinal 10 according to embodiments of the present invention can be mounted within the floor of a restroom such that the user platform 30 is flush or substantially flush with the floor. In some installations, the user platform 30 may have a user access ramp, as will be described below.

The rear wall 12, sidewalls 20, and user platform 30 can be formed together as a monolithic structure of various polymeric materials such as, but not limited to, polypropylene, high density polyethylene, low density polyethylene, polyethylene terephthalate, etc. In some embodiments, the entire urinal 10 can be formed via an injection mold process from a single type of polymeric material (or from blends of different polymeric materials). The ability to injection mold the modular urinal 10 can lower manufacturing costs. Moreover, detailed features, close tolerances, and complex geometry can be achieved via injection molding. However, urinals 10 according to some embodiments of the present invention need not have a monolithic structure. Instead, a urinal 10 can be formed from separate components that are assembled together.

In some embodiments, urinals 10 can be separate, individualized units or units that could be connected in pairs, quads or any desired number of units connected together. For example, a pair of urinals 10 can be manufactured with a common sidewall between them. This common sidewall effectively serves the purpose of a partition between adjacent urinals. Such a common sidewall can have a concave inner surface for each urinal. The use of a common sidewall can save on material costs and reduce overall weight.

Referring to FIGS. 2A-2F, the rear wall inner surface 14 of a urinal 10 can have various curvilinear shapes. In all of the illustrated embodiments, the portion of the rear wall inner surface 14 that receives a stream of urine from a user has a concave configuration that extends away from a user standing on the platform 30. For example, in FIG. 2A, an upper portion 14*a* of the rear wall inner surface 14 has a convex configuration that extends toward a user. However, the lower portion 14*b* of the inner surface 14 is concave and extends away and downward from a user, as illustrated. The lower portion 14*b* is the portion of the inner surface 14 that receives a stream of urine from a user. The concave shape reduces splashing during use and helps direct urine downwardly away from the user toward the drain orifice 16 in the basin B. A stream of urine directed to a surface at a ninety degree (90°) angle will typically cause the most splash back. By making the rear wall inner surface 14 concave, the angle that urine will hit the inner surface 14 can be increased significantly, thereby reducing splash back. In some embodiments, the rear wall inner surface 14 may define an angle ($A_1$, FIG. 2D) relative to vertical of between about one degree and forty-five degrees (1°-45°), although a greater angle is possible.

Figure 2A:
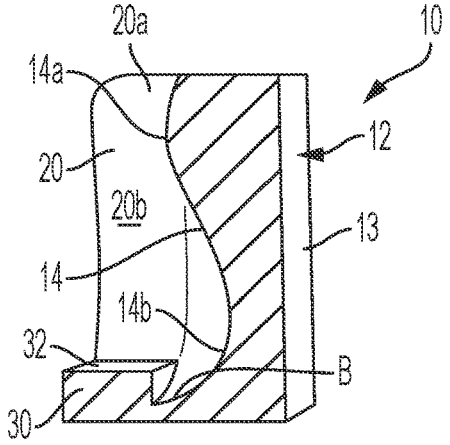
FIGS. 2A-2F are cross sectional views of a urinal according to embodiments of the present invention and illustrating different rear wall inner surface configurations.
Figure 2B:
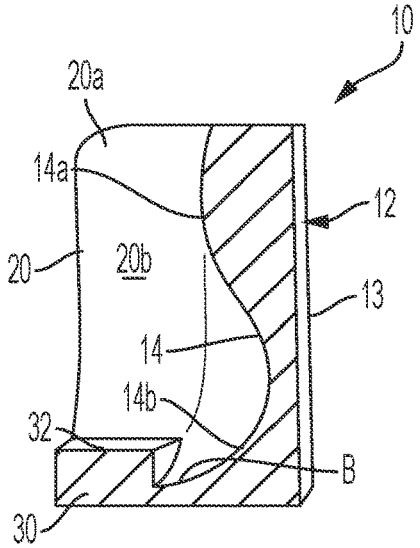
Figure 2C:
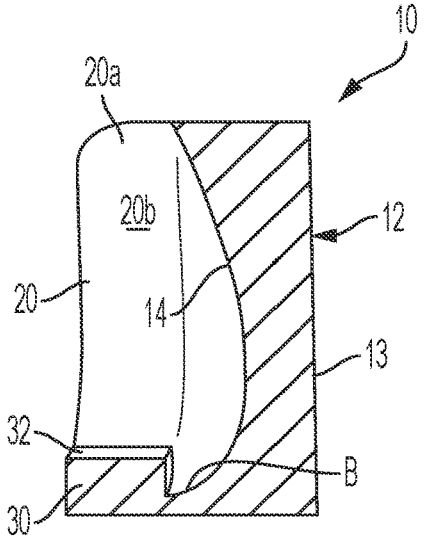
Figure 2D:
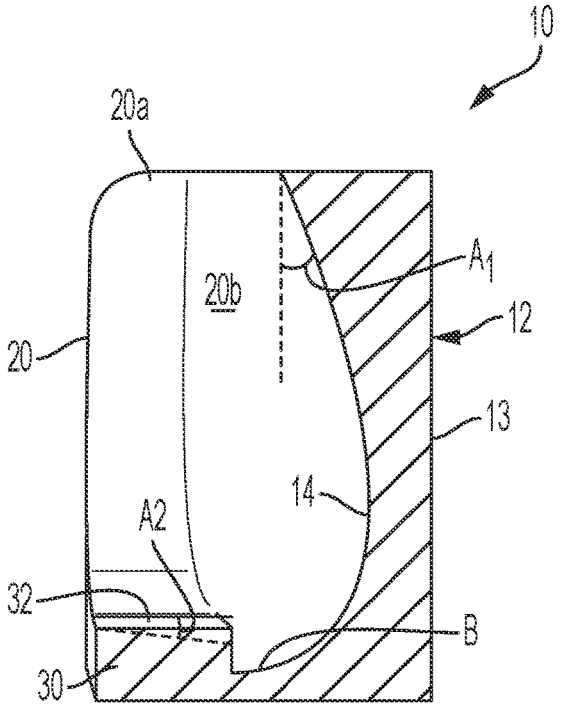
Figure 2E:
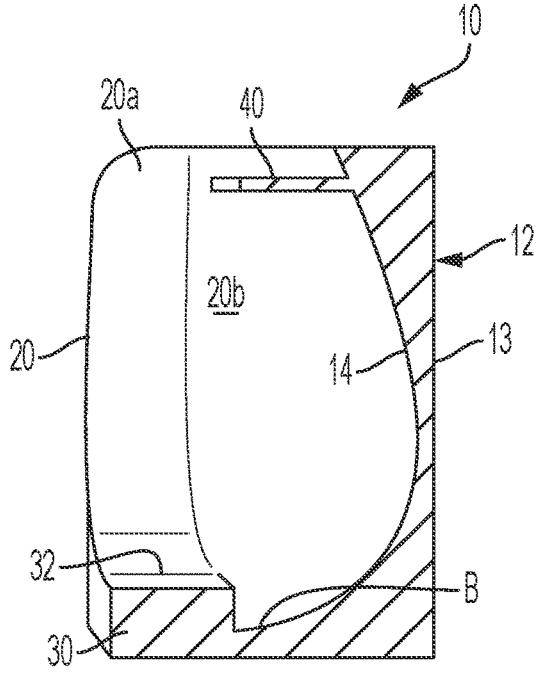

In FIG. 2A, the convex upper portion 14*a* extends closer to a user than the convex upper portion 14*a* of FIG. 2B. In FIG. 2B, the concave lower portion 14*b* extends further away from a user than the concave lower portion 14*b* of FIG. 2A. In FIGS. 2C-2E, the entire rear wall inner surface 14 has a concave configuration. The only difference in the embodiments of FIGS. 2C-2E is how close the rear wall inner surface 14 is to a user standing on the platform 30. In the embodiment shown in FIG. 2C, the rear wall inner surface 14 is closest to the user. In the embodiment shown in FIG. 2E, the rear wall inner surface 14 is furthest from the user. In the embodiment shown in FIG. 2D, the rear wall inner surface 14 is further from the user than the embodiment shown in FIG. 2C, but closer to the user than the embodiment shown in FIG. 2E.

Figure 2F:
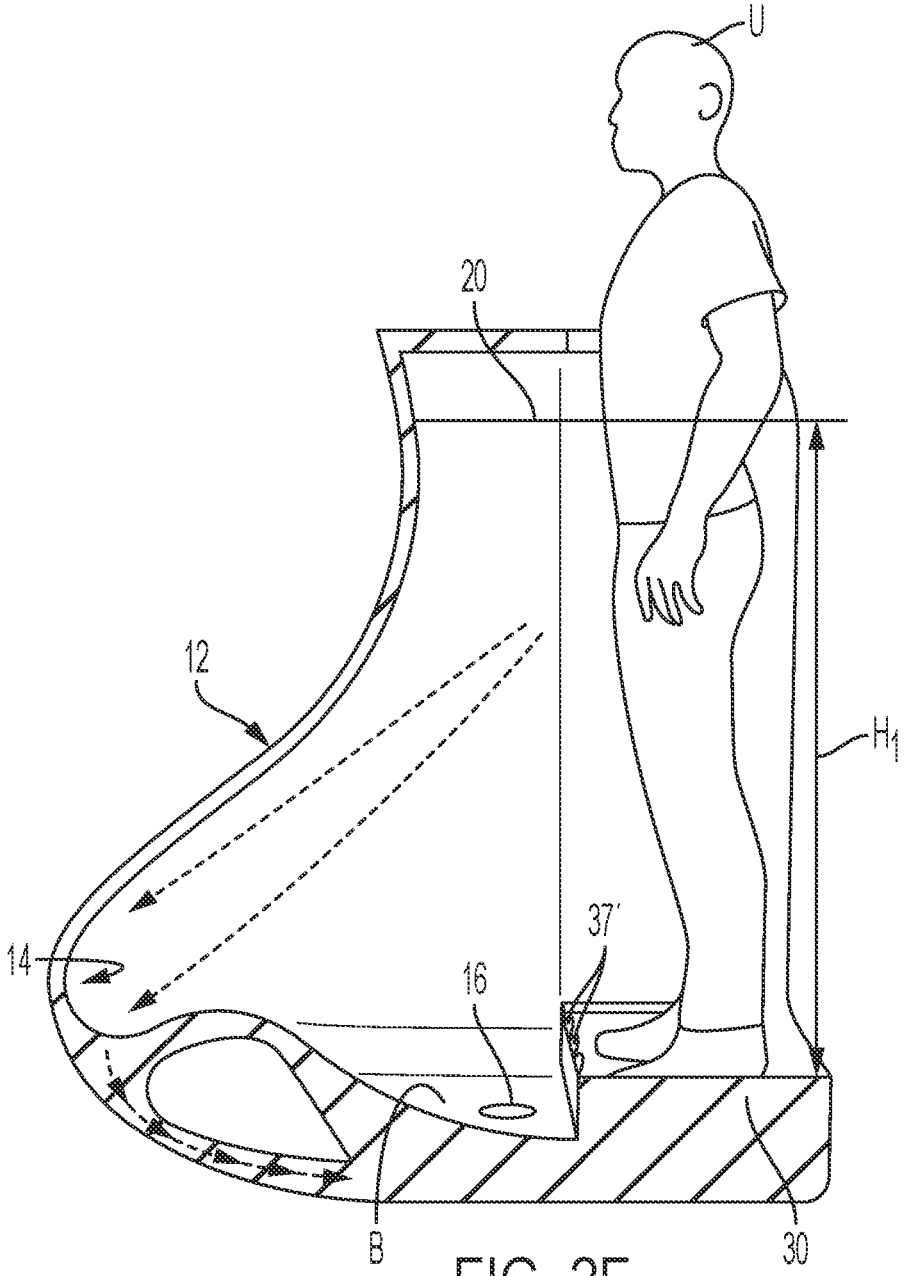

FIG. 2F illustrates an undulating shape for the rear wall inner surface 14 according to other embodiments of the present invention. In addition, the side walls 20 can have a lower height relative to the embodiments illustrated in FIGS. 2A-2E. For example, in some embodiments, the side walls 20 may have a height $H_1$ of about four feet (4'), although other heights are possible.

Figure 5A:
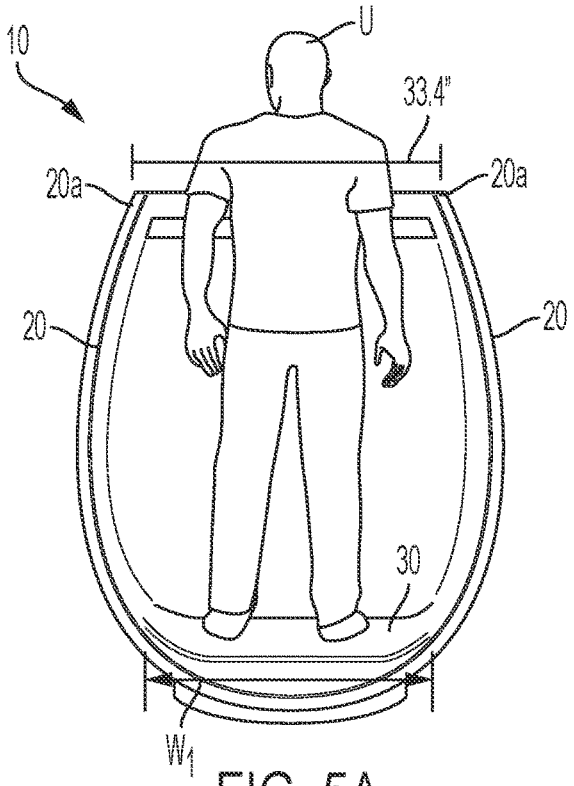
FIGS. 5A-5B are front views of a urinal, according to embodiments of the present invention, and illustrating different concave configurations of the sidewalls.
Figure 5B:
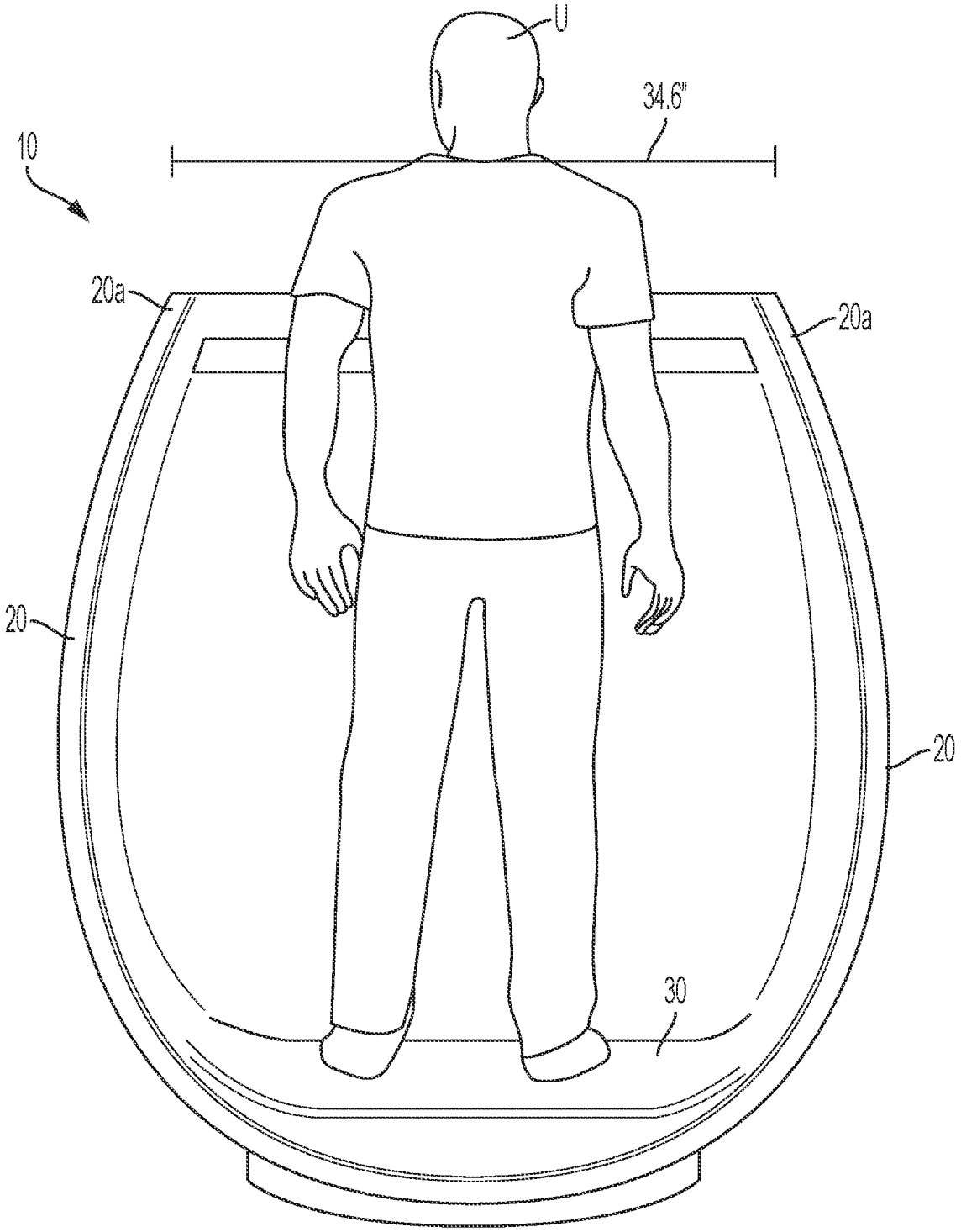

Referring back to FIGS. 1A-1B, the sidewalls 20 have opposing concave configurations, as illustrated. Each sidewall 20 extends upwardly and outwardly from the platform and then has an upper free end portion 20*a* that extends back toward where a user is positioned during use. In some embodiments, the upper end portions 20*a* of the sidewalls 20 are spaced apart between about thirty-two inches and thirty-six inches (32"-36"), as illustrated in FIGS. 5A-5B. However, embodiments of the present invention are not limited to this range. In other embodiments, the upper end portions 20*a* of the sidewalls 20 may be spaced apart by an amount less than thirty-two inches (32") or may be spaced apart by an amount greater than thirty-six inches (36").

In some embodiments, the user platform 30 is tilted slightly downward relative to horizontal, and toward the basin B in which the drain orifice 16 is located. A tilt angle ($A_2$, FIG. 2D) may be between about one degree and about twenty-five degrees (1°-25°) relative to horizontal, although other angles are possible. The downward tilt of the platform 30 allows urine and other liquids on the platform 30 to flow into the urinal basin B and into the drain orifice 16. This helps reduce splash and urine on the floor of a restroom. However, embodiments of the present invention are not limited to an angled user platform 30. In some embodiments, the user platform 30 may be substantially horizontal. In some embodiments, the width $W_1$ (FIG. 5A) of the user platform 30 may be between about twelve inches and twenty-four inches (12"-24"), and the depth $D_1$ (FIG. 4C) of the user platform 30 may be between about twelve inches and twenty inches (12"-20"), although other dimensions are possible.

In some embodiments, the surface 32 of the user platform 30 upon which a user stands may have a slip-resistant configuration. For example, in some embodiments, the surface 32 of the platform 30 may include a plurality of raised features 33 (FIG. 1A). In other embodiments, the surface 32 of the platform 30 may have an abrasive material thereon or the surface 32 may be treated so as to have a roughened configuration. In other embodiments, the surface 30*a* may have a resilient material, such as rubber or silicone, thereon.

Anti-slip features for the user platform surface 32 may also be produced via part geometry or surface texture in a single material, including elastomeric anti-slip features that are formed integrally with the platform surface 32. In some embodiments, the user platform 30 may have a disposable mat, that can be replaced as needed. The mat can have raised features, also.

Figure 6A:
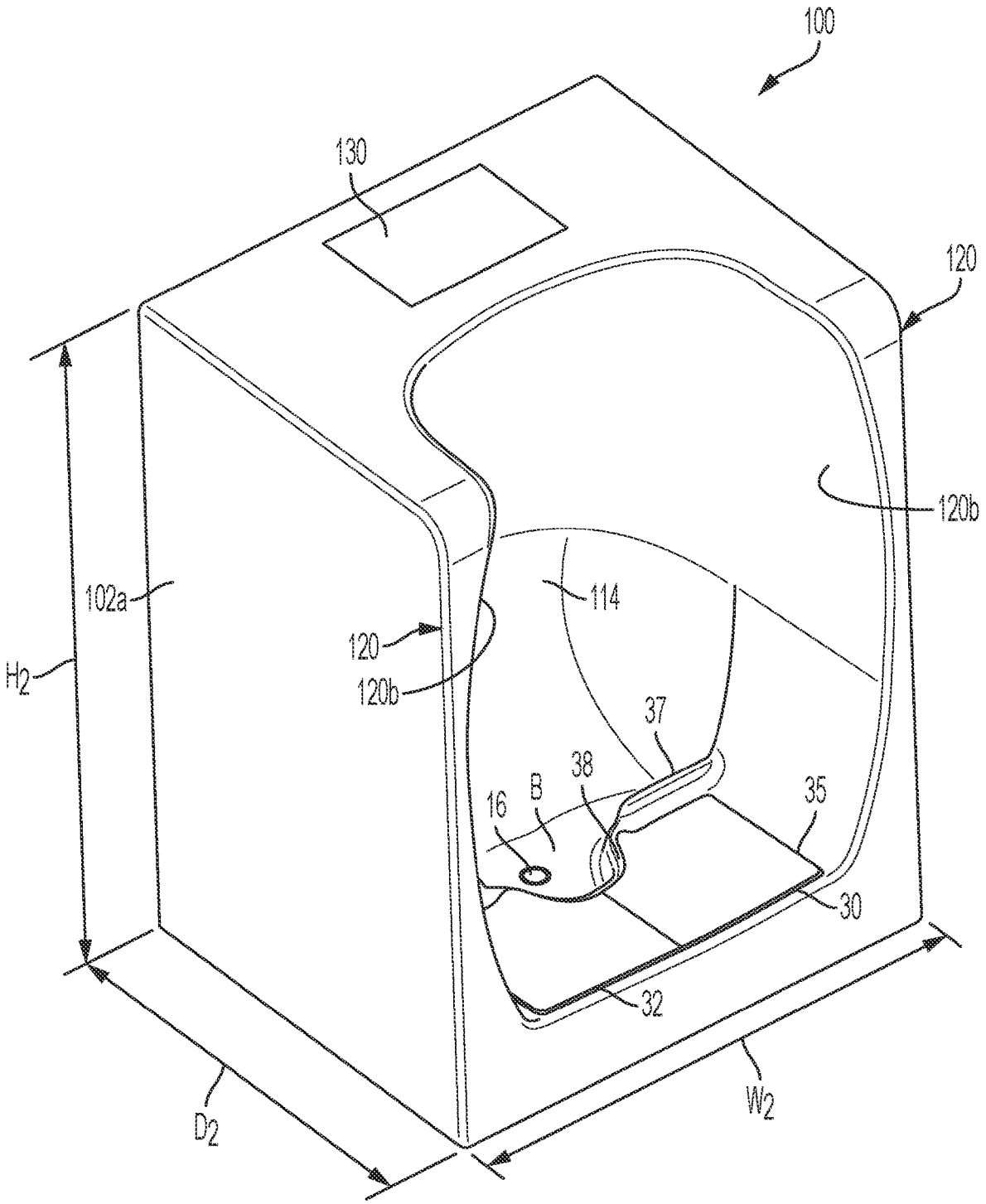
FIGS. 6A-6B are front perspective views of a urinal, according to some embodiments of the present invention.
Figure 6B:
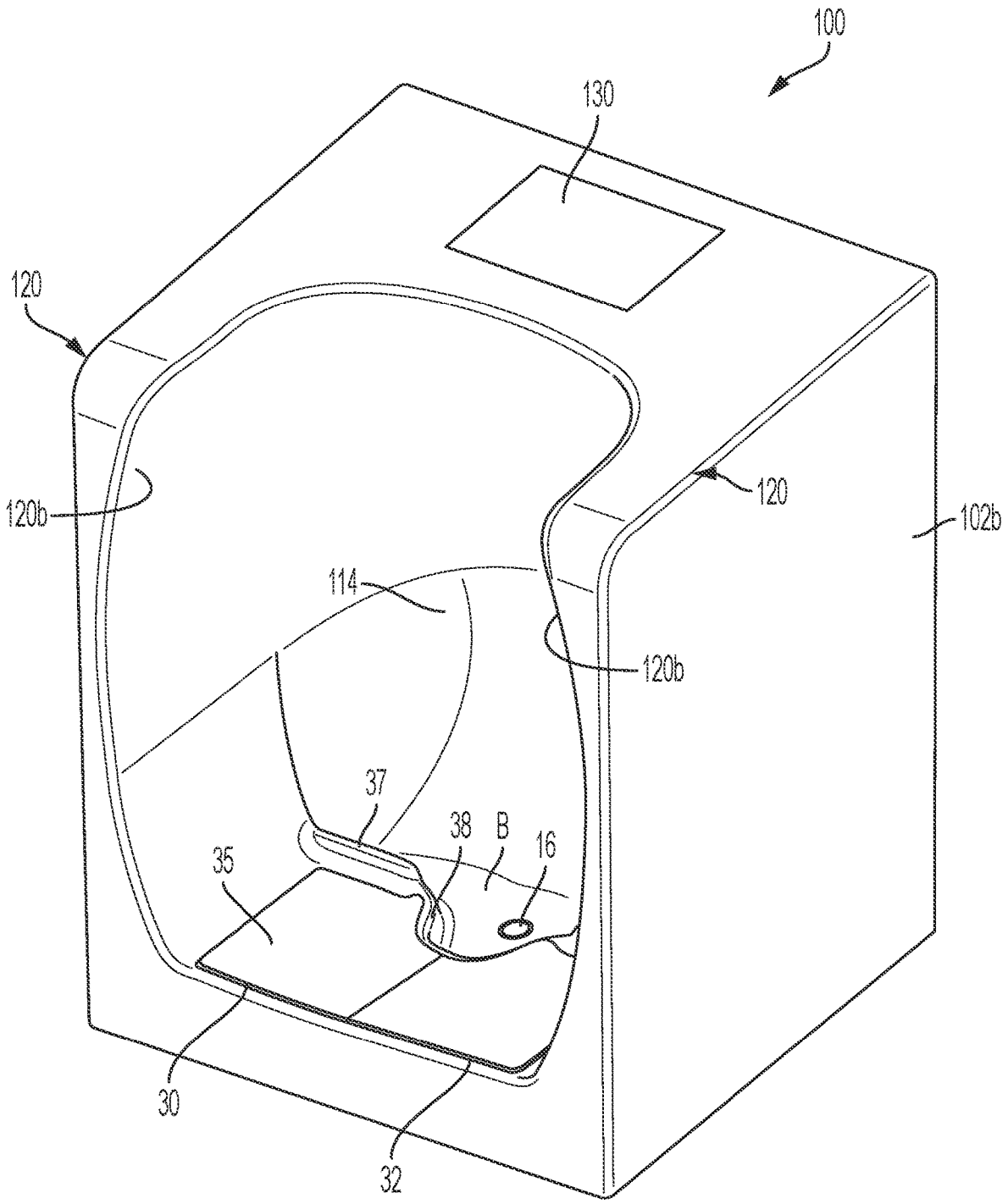
Figure 6C:
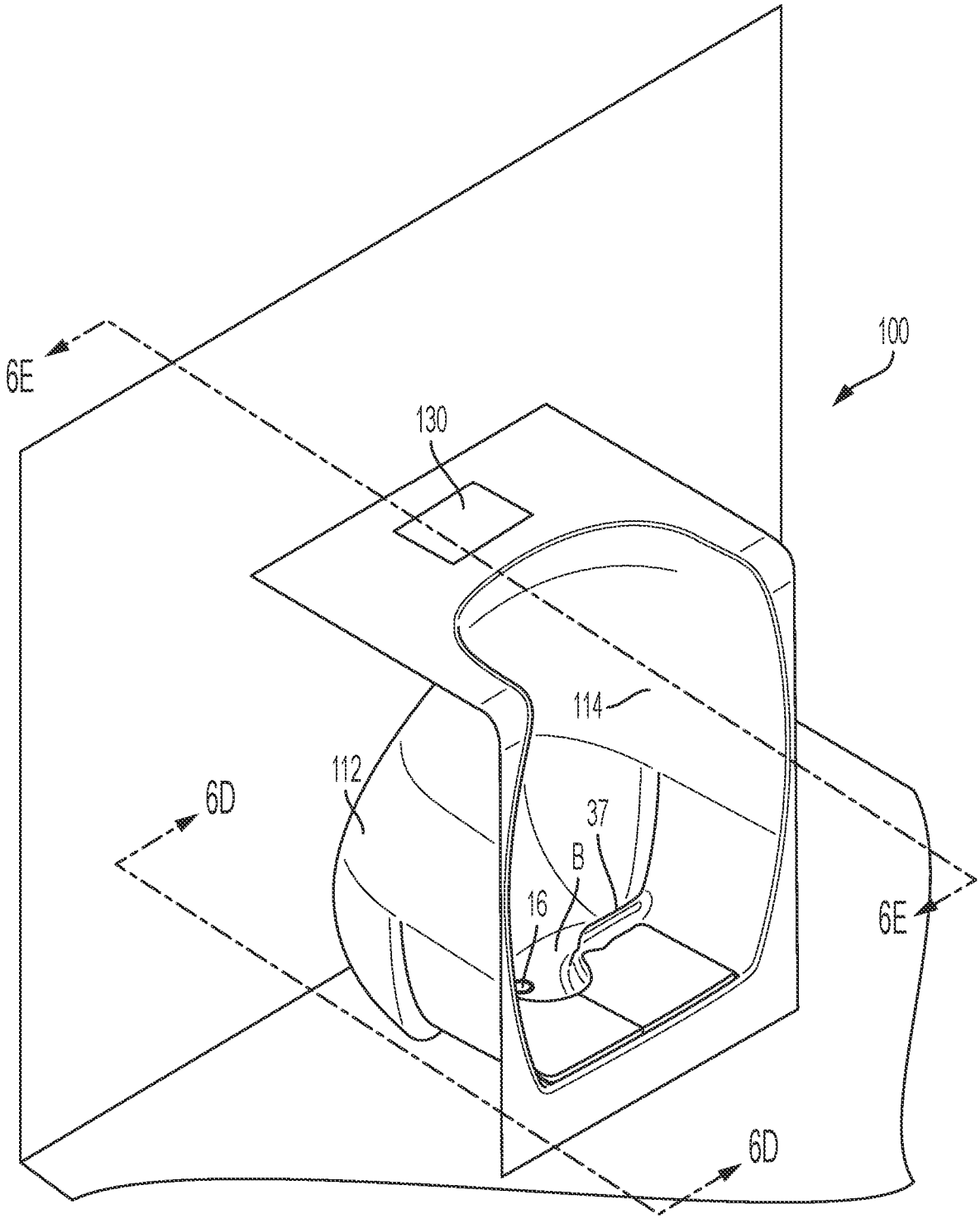
FIG. 6C illustrates the urinal of FIG. 6A with the side, rear and bottom walls not illustrated for clarity.

In some embodiments, the user platform 30 may include a foot-stopper 37 (FIGS. 6A-6C) for additional safety precautions. Such a foot-stopper is configured to help prevent a user from inadvertently stepping into the urinal 10 and to help prevent a user's foot from slipping into the urinal 10. In some embodiments, a series of raised and rounded teeth 37' (FIG. 2F) may be provided that protrude from the most inner portion of the platform 30 adjacent to the inner edge to serve the purpose of a foot-stopper. The teeth 37' are spaced apart, for example, between about one-eighth of an inch to one inch (⅛"-1") for cleaning and drainage purposes. The teeth 37' may be rounded at the top and have a diameter ranging from about one-half inch to one inch (½"-1"), although other dimensions are possible. The teeth 37' may have a height between about one-half inch to three inches (½"-3"), although other dimensions are possible. However, embodiments of the present invention may utilize other structures configured to act as a foot-stopper. Embodiments of the present invention are not limited to the use of raised teeth 37'. As described below, a foot stopper 37 may be a raised continuous element as illustrated in FIGS. 6A-6C.

The rear wall inner surface 14 may include a splash-resistant material applied to one or more portions thereof. Similarly, the inner surface 20*b* of each of the sidewalls 20 may include a splash-resistant material applied to one or more portions thereof. For example, a thin layer or coating of a soft, resilient material, such as a gel (e.g., silicone) or rubber can be applied to the inner surfaces 14, 20*b*. A soft, resilient material can deform when impacted by a urine stream and by urine droplets, thereby absorbing energy and suppressing splash.

According to other embodiments, a thin layer or coating of hydrophobic material can be applied to one or more portions of the inner surfaces 14, 20*a* of the rear wall and sidewalls, respectively. Hydrophobic material can reduce the puddling of urine on a surface. Puddling can cause splash back when hit by more urine. In addition, bacteria can breed in puddles of urine within a urinal and on a floor, and is one of the reasons that public restrooms often smell so bad. Moreover, the presence of bacteria caused by splash back and puddling can pose a serious health risk in hospitals, nursing homes, and other large institutions.

In some embodiments, the urinal 10 may include a substantially horizontal upper wall 40 extending outwardly from the rear wall inner surface 14 between the upper end portions 20*a* of the sidewalls 20, as illustrated in FIGS. 1A-1B and 4A-4C. In some embodiments, the upper wall 40 extends outward from the rear wall inner surface 14 between about one inch and twelve inches (1"-12"), although other dimensions are possible. In some embodiments, the upper wall 40 has a thickness of about one inch (1"), and a length between side walls 20 of between about twelve inches and twenty-four inches (12"-24"), although other dimensions are possible. The upper wall 40 further helps create an enclosed stall configuration which helps contain splash within the urinal 10. Together, the upper wall 40, sidewalls 20, and rear wall 12 create a walk-in enclosure or personal stall that dramatically increases the ability to contain splash back and keep restroom floors clean and dry. Although the rear wall 12, sidewalls 20, and upper wall 40 can have different shapes and configurations, the overall concept of the present invention creating a walk-in enclosure or stall remains the same.

Figure 3C:
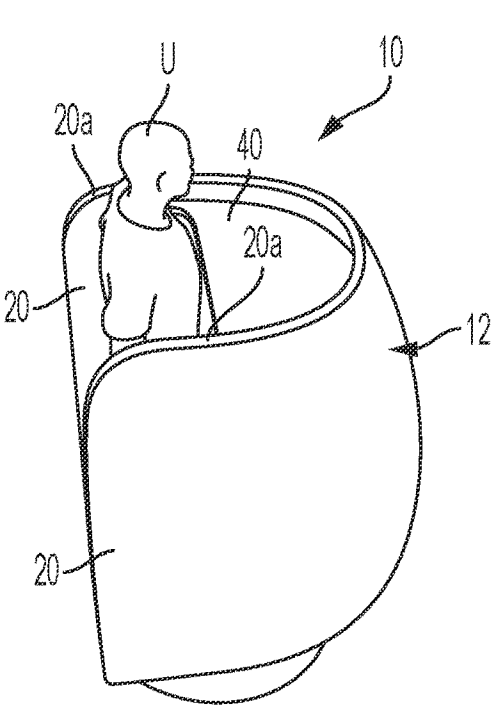
FIGS. 3A-3C are perspective views of a urinal, according to some embodiments of the present invention, with a user standing on a platform thereof and illustrating the walk-in stall configuration of the urinal.
Figure 3B:
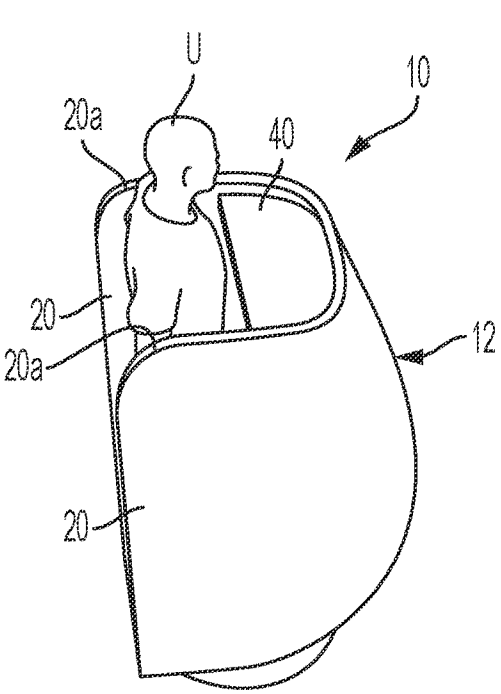
Figure 3A:
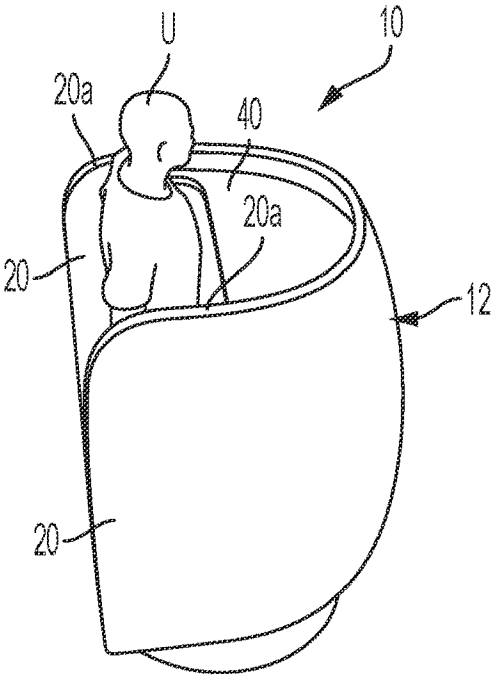
Figure 4A:
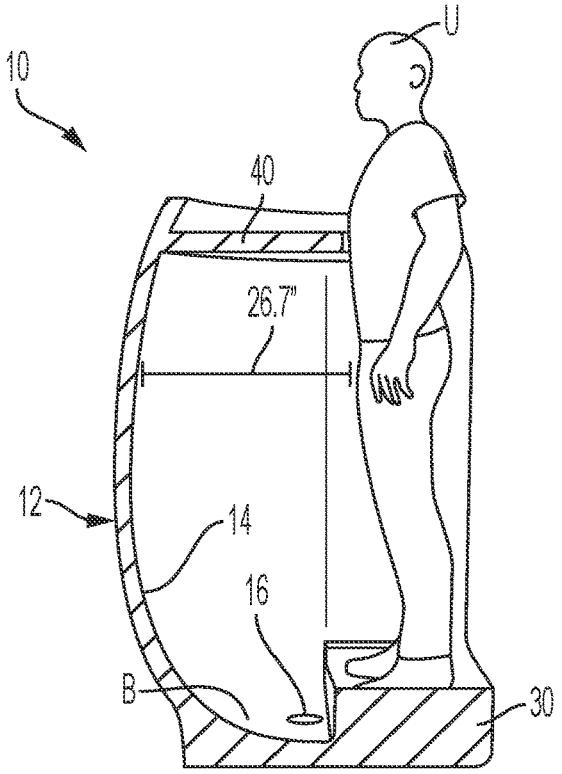
FIGS. 4A-4C are cross sectional views of a urinal, according to embodiments of the present invention, and illustrating different concave configurations of the rear wall.
Figure 4B:
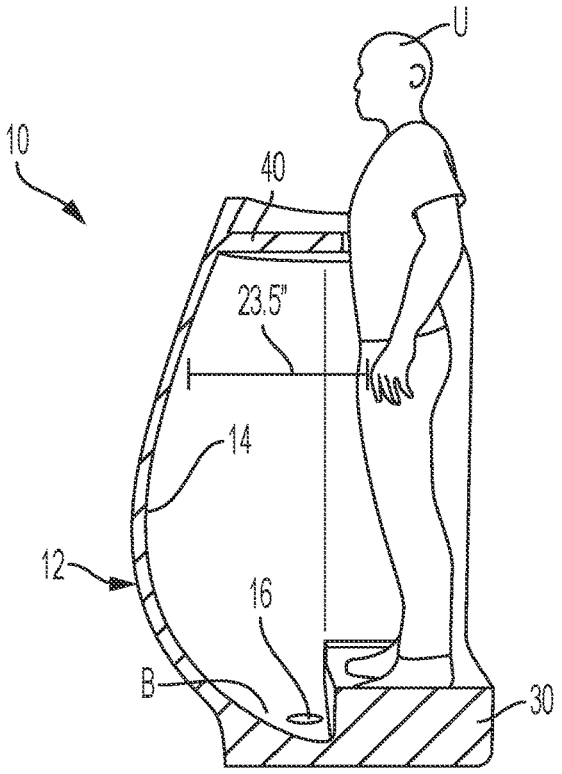
Figure 4C:
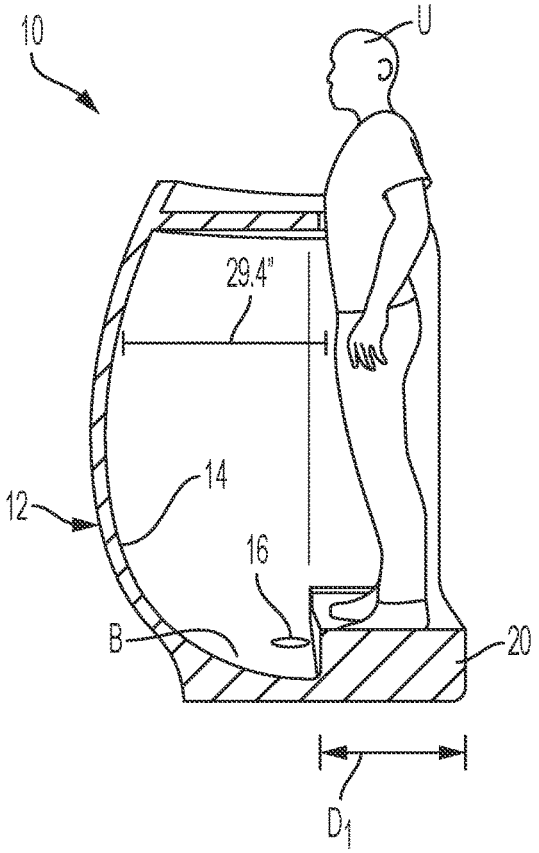

FIGS. 3A-3C illustrate this walk-in enclosure or stall concept, even with the urinal module having different shapes and sizes.

Figure 6D:
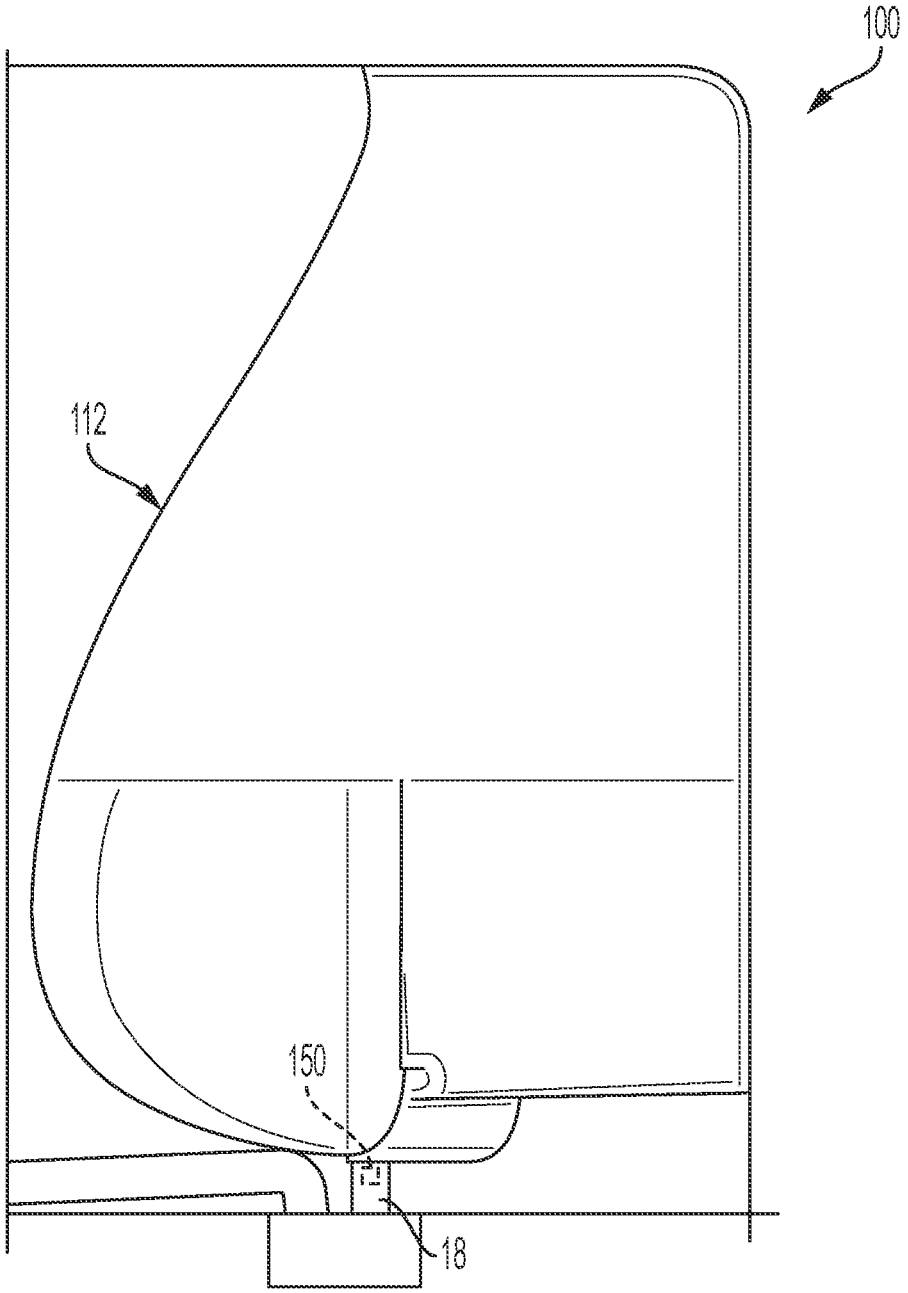
FIG. 6D is a side view of the urinal of FIG. 6C taken along line 6D-6D.
Figure 6E:
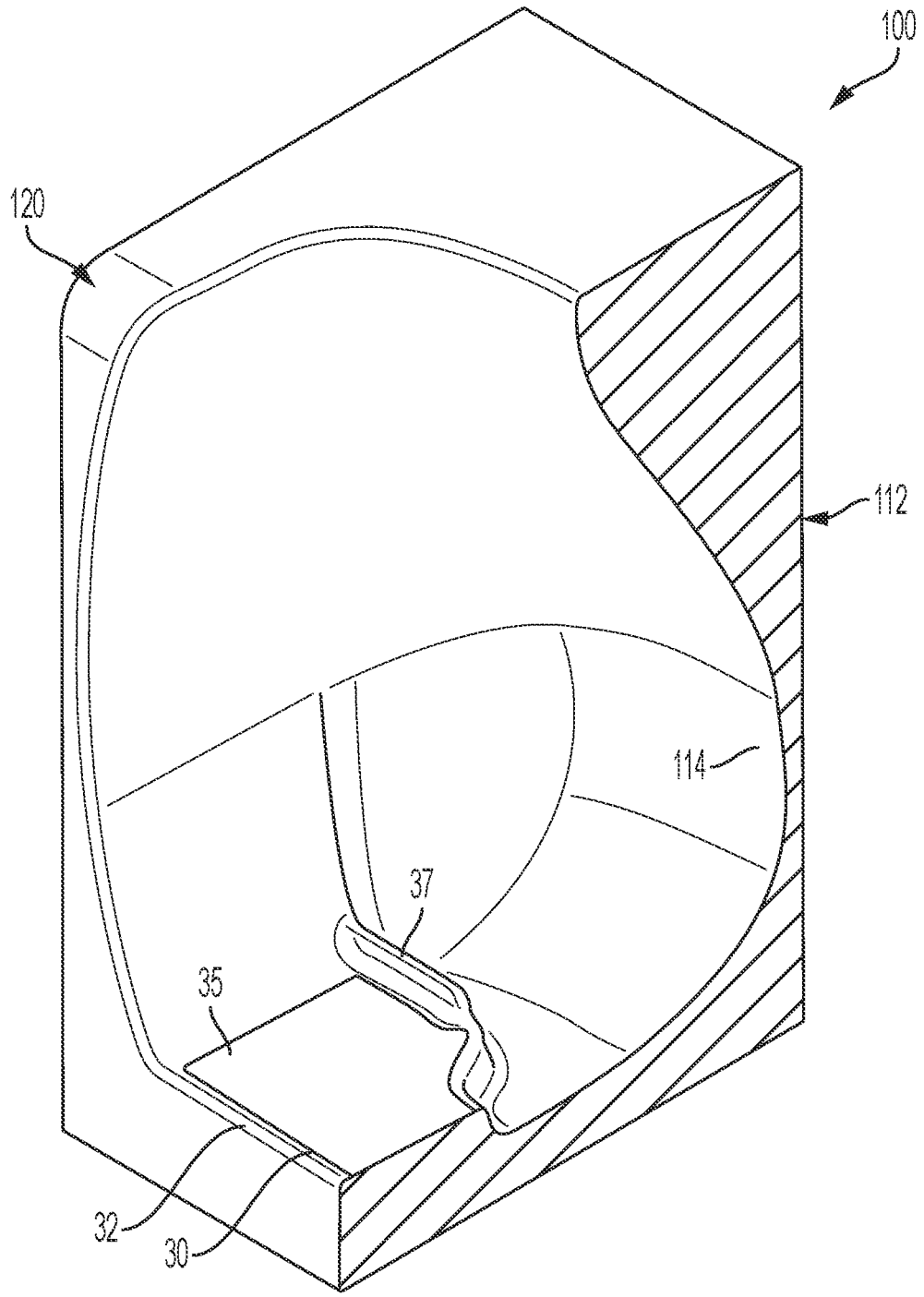
FIG. 6E is a cross-sectional view of the urinal of FIG. 6C taken along line 6E-6E.
Figure 7:
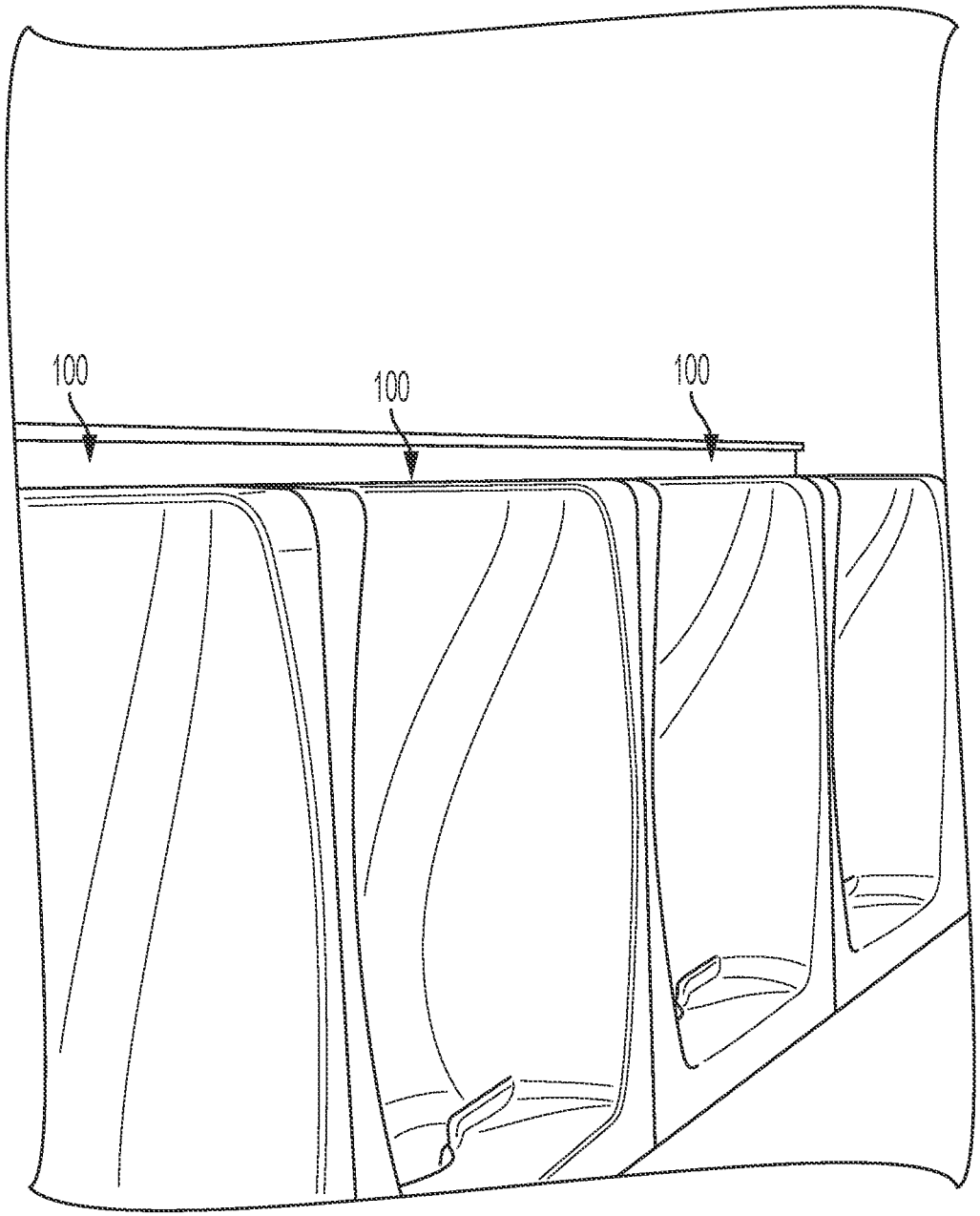
FIG. 7 illustrates a plurality of the urinals of FIGS. 6A-6B in side-by-side arrangement.

Referring to FIGS. 6A-6E, an anti-splash urinal 100, according to some embodiments of the present invention, are illustrated. Similar to the anti-splash urinal 10 described above, the illustrated urinal 100 has a "walk-in" structure that serves as a personal stall, and includes various surface curves and angles that direct urine away from a user's body and thus significantly reduce splash back. The illustrated urinal 100 includes opposite sidewalls 120 with outer surfaces 102*a*, 102*b* that are substantially flat so as to allow the urinals 100 to be installed in a restroom in a side-by-side configuration (e.g., adjacent contacting relationship or adjacent closely-spaced relationship), as illustrated in FIG. 7. Similar to the urinal 10 described above, the illustrated urinal 100 includes a rear wall 112 (FIG. 6D) having a concave inner surface 114 extending downward toward a drain orifice 16 in the basin B of the urinal 100. The drain orifice 16 is in fluid communication with a sanitary drain line and waste trap arrangement 18, as illustrated in FIG. 6D. The sanitary drain line and waste trap arrangement 18 is configured to be connected to a sanitary sewer system, as would be understood by one skilled in the art.

Exemplary dimensions for the urinal 100 include a height $H_2$ of about fifty-four inches (54"), a depth $D_2$ of about thirty-eight inches (38"), and a width $W_2$ of about forty-seven inches (47"). However, embodiments of the present invention are not limited to these dimensions. The urinal 100 can have a height $H_2$, width $W_2$, and depth $D_2$ of various lengths, without limitation.

Similar to the urinal 10 described above, the illustrated urinal 100 of FIGS. 6A-6E includes a user platform 30 positioned between the sidewalls 120. The platform 30 is elevated relative to the basin B of the urinal 100 that contains the drain orifice 16. The sidewalls 120 are configured such that, when a user is standing on the platform 30, the user is positioned substantially entirely between the sidewalls 120. As such, the modular urinal 100 is effectively a walk-in stall, and a user is effectively "enclosed" within the stall during use. In other words, the user's body in combination with the sidewalls 120 and rear wall define an enclosure that effectively reduces the possibility of urine from splashing outwardly onto the floor of a restroom. However, embodiments of the present invention do not require that a user be positioned entirely between the sidewalls 120. For example, a portion of a user's body may extend slightly outwardly from the front edges of the sidewalls 120.

The illustrated user platform 30 is angled slightly downward relative to horizontal and toward the basin B to facilitate liquid on the platform 30 flowing into the basin B of the urinal 100. The user platform 30 includes a cutout portion 38 along the inner edge thereof, as illustrated. This cut out portion 38 is positioned such that urine from a user has a greater likelihood of flowing into the basin B without contacting the user platform 30 first. The portion of the user platform 30 adjacent to the cutout portion 38 may have additional downward slope to facilitate liquid on the user platform draining into the urinal basin B at the cutout portion 38.

Similar to the urinal 10 described above, one or more portions of the rear wall inner surface 114, as well as one or more portions of the inners surface 120*b* of each sidewall 20, may include a splash-resistant material applied thereto, such as a thin layer or coating of a soft, resilient material, such as a gel (e.g., silicone) or rubber.

The illustrated urinal 100 includes a slip-resistant mat 35 on the surface 32 of the platform 30. The illustrated mat 35 conforms to the contour and shape of the platform 30 and may be removably secured to the platform so it can be replaced when worn. The mat 35 may be a resilient material, such as rubber, silicone, or other similar materials that provide an anti-slip surface even when wet. Because the mat 35 conforms to the contour and shape of the user platform 30, the portion of the mat 35 on the user platform 30 adjacent to the cutout portion 38 also slopes downwardly toward the basin B to facilitate liquid on the mat 35 draining into the urinal basin B at the cutout portion 38. Any raised portions provided on the mat 35 are arranged and configured so as not to hinder the flow of liquid into the basin at the cutout portion 38.

The illustrated platform 30 also includes raised portions 37 adjacent the inner edge of the platform 30 and on each side of the cutout portion 38, as illustrated. Each raised portion 37 serves the function of a foot-stopper to help prevent a user from inadvertently stepping into the urinal 100 and to help prevent a user's foot from slipping into the urinal 100. Moreover, the height and curved configuration of the raised portion 37 helps eliminate splash back onto a user's shoes and lower leg areas during use. In some embodiments, each raised portion 37 may have a height of between about one-half inch to about two three (½"-3"). However, the raised portions 37 may have other heights, and may have other configurations, as well.

The illustrated urinal 100 may also include a display 130. When provided, the display 130 may be configured to display advertising information or other information to a user of the urinal 100 or may be utilized for other purposes. For example, in some embodiments, the urinal 100 may include a sensor 150 that is configured to analyze the urine of a user for drugs, diabetes, alcohol, diseases, etc. The display 130 can display information about any analysis of urine of a user, or can be utilized to display various information about drug use, diseases, etc. The sensor 150 may be located in the drain pipe 18, as illustrated in FIG. 6D, or may be located in another portion of the urinal, such as the basin B, as would be understood by one of skill in the art. The display 130 may be activated when a user is detected on the platform 30, for example by a sensor. Such a sensor may be an optical sensor configured to detect the presence of a user. In some embodiments, such a sensor may be a pressure sensor associated with the user platform 30 that detects when a user is standing on the platform 30. The display 130 may be deactivated when a user is no longer detected on the platform 30.

Figure 8:
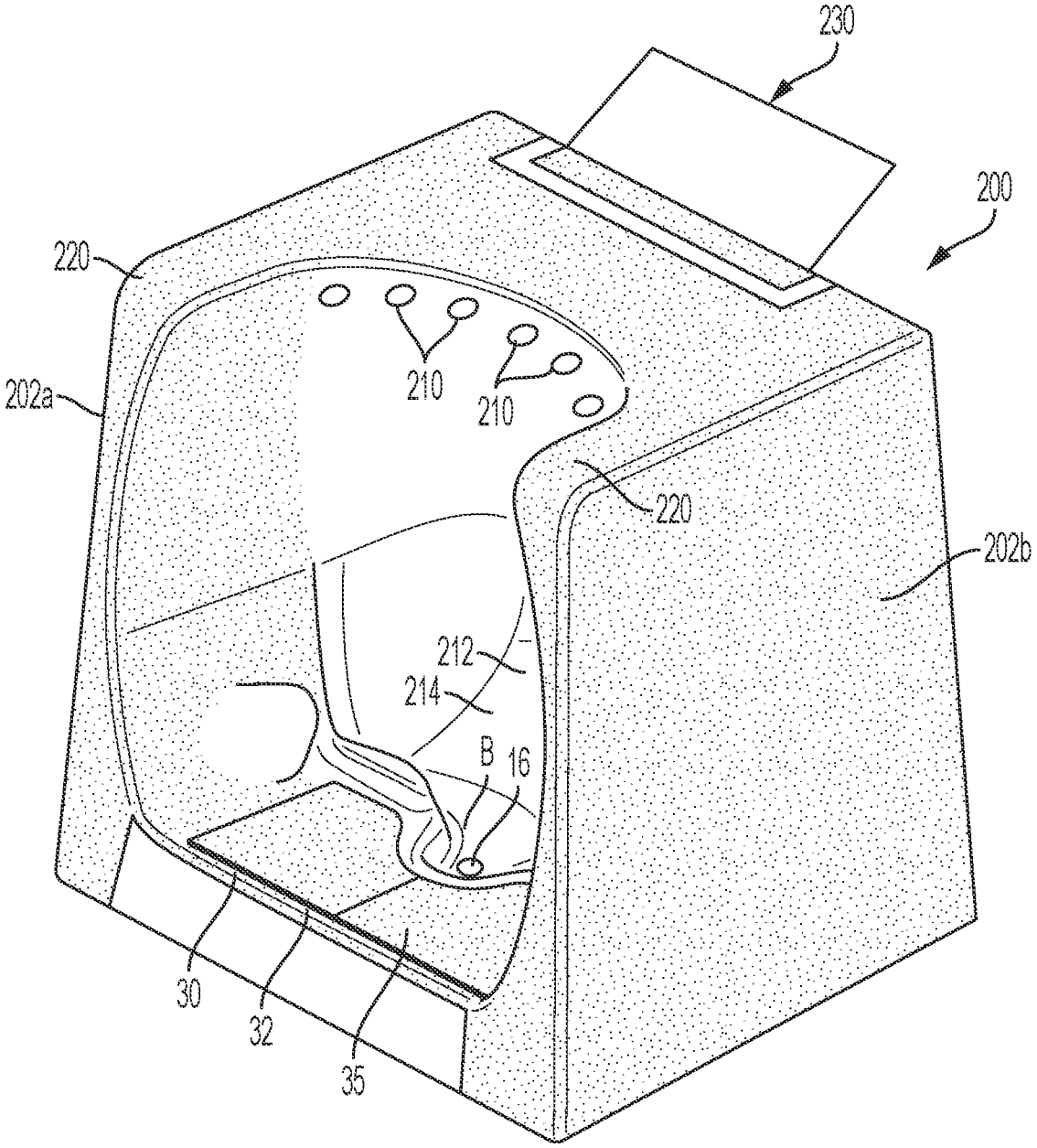
FIG. 8 is a front perspective view of a urinal, according to some embodiments of the present invention.

Referring to FIG. 8, an anti-splash urinal 200, according to some embodiments of the present invention, is illustrated. Similar to the anti-splash urinals 10, 100 described above, the illustrated urinal 200 has a "walk-in" structure that serves as a personal stall, and includes various surface curves and angles that direct urine away from a user's body and thus significantly reduce splash back. The illustrated urinal 200 includes opposite sidewalls 220 with outer surfaces 202*a*, 202*b* that are substantially flat so as to allow the urinals 100 to be installed in a side-by-side configuration. Similar to the urinals 10, 100 described above, the illustrated urinal 20 includes a rear wall 212 having a concave inner surface 214 extending downward toward a drain orifice 16 formed in a basin B of the urinal 200. The drain orifice 16 is in fluid communication with a sanitary drain line and waste trap arrangement, as described above.

Similar to the urinals 10, 100 described above, the illustrated urinal 200 includes a user platform 30 positioned between the sidewalls 220. The platform 30 is elevated relative to the basin B of the urinal 200. The sidewalls 220 are configured such that, when a user is standing on the platform 30, the user is positioned substantially entirely between the sidewalls 220. As such, the modular urinal 200 is effectively a walk-in stall, and a user is effectively "enclosed" within the stall during use. In other words, the user's body in combination with the sidewalls 220 and rear wall define an enclosure that effectively reduces the possibility of urine from splashing outwardly onto the floor of a restroom. However, embodiments of the present invention do not require that a user be positioned entirely between the sidewalls 220. For example, a portion of a user's body may extend slightly outwardly from the front edges of the sidewalls 220.

The illustrated urinal 200 includes a slip-resistant mat 35 on the surface 32 of the platform 30. The illustrated mat 35 conforms to the contour and shape of the platform 30 and may be configured to be replaced when worn. The mat 35 may be a resilient material, such as rubber, silicone, or other similar materials that provide an anti-slip surface even when wet.

The walls of the illustrated urinal 200, or portions of the walls, can have one or more colors, as indicated by the stippling in FIG. 8. The use of color can increase the visibility of the urinal 200 within a restroom, and can be selected to enhance aesthetics. For example, the color(s) can be selected to match the color of a wall and/or floor of a restroom, or to provide contrast from the wall and/or floor of a restroom.

The illustrated urinal 200 also includes a plurality of lights 210 that are configured to illuminate the interior of the urinal 200 during use. The illustrated lights 210 may be located on or near the inner surface 214 of the rear wall 212, or may be located so that light is displayed on the inner surface 214 of the rear wall 212. However, embodiments of the present invention are not limited to the illustrated location, number or arrangement of lights 210. Various numbers of lights 210 may be utilized, including a single light 210. Moreover, the lights 210 may be arranged in different patterns and at different locations than illustrated. In some embodiments, the lights 210 may be switched on when a user is detected on the platform 30, for example by a sensor. Such a sensor may be an optical sensor configured to detect the presence of a user. In some embodiments, such a sensor may be a pressure sensor associated with the user platform 30 that detects when a user is standing on the platform 30. The lights 210 may be switched off when a user is no longer detected as being on the platform 30.

The illustrated urinal 200 also includes a display 230. The display 230 may be configured to display advertising information or other information to a user of the urinal 200 or may be utilized for other purposes, as described above. The display 230 may be activated when a user is detected on the platform 30, for example by a sensor. The display 230 may be deactivated when a user is no longer detected on the platform 30.

Figure 9:
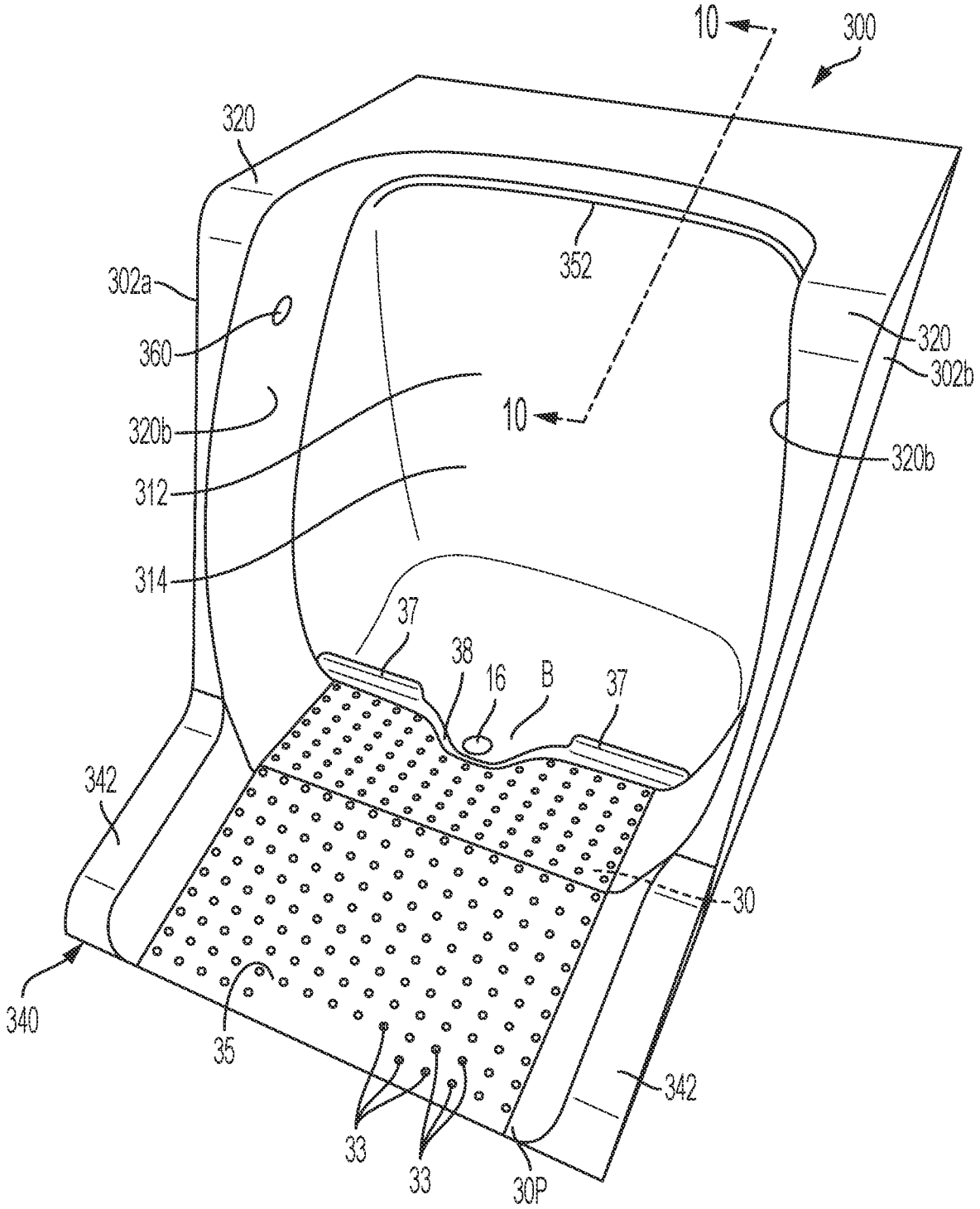
FIG. 9 is a front perspective view of a urinal having a user access ramp, according to some embodiments of the present invention.
Figure 11:
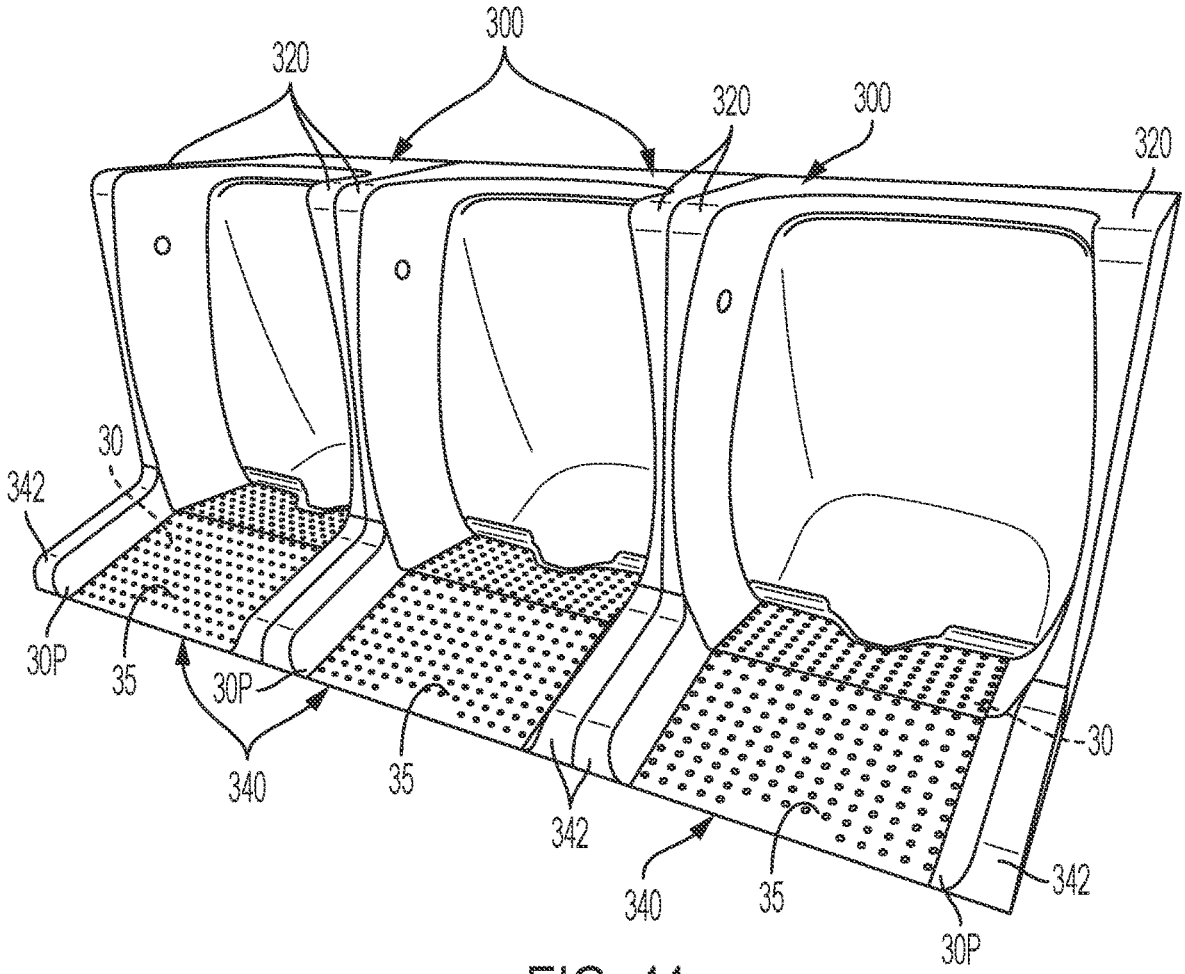
FIG. 11 illustrates a plurality of the urinals of FIG. 9 in side-by-side arrangement.

Referring to FIG. 9, an anti-splash urinal 300, according to some embodiments of the present invention, is illustrated. Similar to the anti-splash urinals 10, 100, 200 described above, the illustrated urinal 300 has a "walk-in" structure that serves as a personal stall, and includes various surface curves and angles that direct urine away from a user's body and thus significantly reduce splash back. The illustrated urinal 300 includes opposite sidewalls 320 with outer surfaces 302*a*, 302*b* that are substantially flat so as to allow the urinals 300 to be installed in a side-by-side configuration (e.g., adjacent contacting relationship or adjacent closely-spaced relationship), as illustrated in FIG. 11. Similar to the urinals 10, 100, 200 described above, the illustrated urinal 300 includes a rear wall 312 having a concave inner surface 314 extending downward toward a drain orifice 16 formed in a basin B of the urinal 300. The drain orifice 16 is in fluid communication with a sanitary drain line and waste trap arrangement, as described above.

Similar to the urinals described above, the illustrated urinal 300 of FIG. 9 includes a user platform 30 positioned between the sidewalls 320. The platform 30 is elevated relative to the basin B of the urinal 100 that contains the drain orifice 16. The sidewalls 320 are configured such that, when a user is standing on the platform 30, the user is positioned substantially entirely between the sidewalls 320. As such, the modular urinal 300 is effectively a walk-in stall, and a user is effectively "enclosed" within the stall during use. In other words, the user's body in combination with the sidewalls 320 and rear wall define an enclosure that effectively reduces the possibility of urine from splashing outwardly onto the floor of a restroom. However, embodiments of the present invention do not require that a user be positioned entirely between the sidewalls 320. For example, a portion of a user's body may extend slightly outwardly from the front edges of the sidewalls 320.

The illustrated user platform 30 is angled slightly downward relative to horizontal and toward the basin B to facilitate liquid on the platform 30 flowing into the basin B of the urinal 100. The user platform 30 includes a cutout portion 38 along the inner edge thereof, as illustrated. This cut out portion 38 is positioned such that urine from a user has a greater likelihood of flowing into the basin B without contacting the user platform 30 first. The portion of the user platform 30 adjacent to the cutout portion 38 may have additional downward slope to facilitate liquid on the user platform draining into the urinal basin B at the cutout portion 38.

Similar to the urinals described above, the rear wall inner surface 314, as well as the inners surface 320*b* of each sidewall 20, may also include a splash-resistant material applied to one or more portions thereof, such as a thin layer or coating of a soft, resilient material, such as a gel (e.g., silicone) or rubber.

The illustrated urinal 300 includes a user access ramp 340 connected to the user platform 30, as illustrated. In some embodiments, the user access ramp 340 is a separate component that can be attached to the urinal 300. In other embodiments, the user access ramp 340 and urinal 300 can be formed as a monolithic structure, for example via injection molding. The user access ramp 340 facilitates ease of user access to the urinal 300 by not requiring a user to step up onto, or down off of, the user platform 30. The illustrated user access ramp 340 includes two spaced apart sidewalls 342 and a ramp platform 30*p* between the sidewalls. The ramp platform 30*p* connects with the user platform 30 to form a substantially continuous surface upon which a user accesses and uses the urinal 300.

The urinal 300 includes a slip-resistant mat 35 on the ramp platform 30*p* and user platform 30, as illustrated. The illustrated mat 35 conforms to the contour and shape of the ramp platform 30*p* and the user platform 30 and may be configured to be replaced when worn. The mat 35 may be a resilient material, such as rubber, silicone, or other similar materials that provide an anti-slip surface even when wet. The illustrated mat 35 includes raised portions 33 that are configured to keep a user's shoes from slipping on the sloping surface of the platform 30 as well as the sloping surface of the ramp platform 30*p*. Fluid is able to drain around the raised portions 33, downward into the urinal basin B at the cutout portion 38 in the user platform 30.

Figure 10:
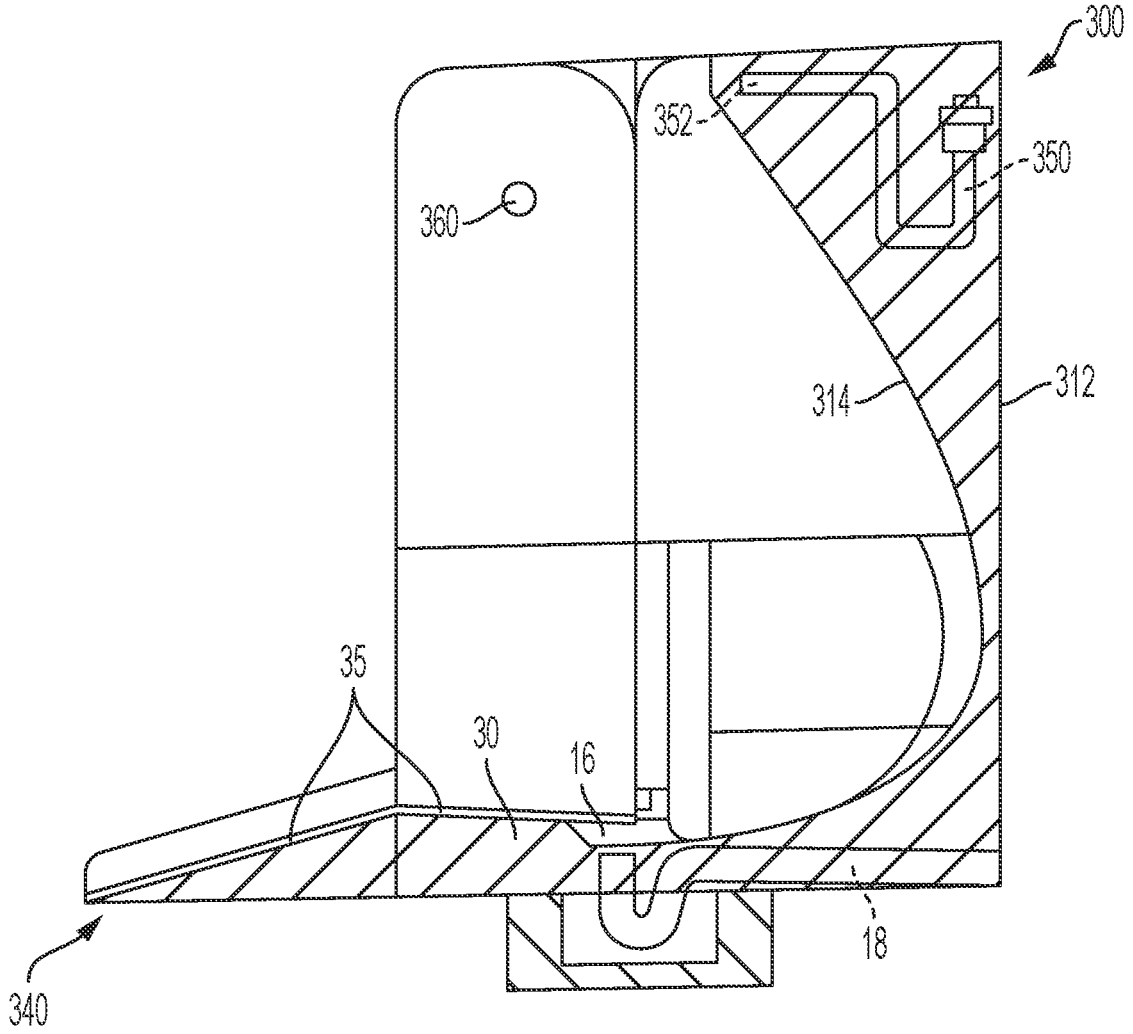
FIG. 10 is a cross sectional view of the urinal of FIG. 9 taken along line 10-10.

The illustrated urinal 300 includes a sensor 360 in one of the sidewalls 320. The sensor 360 may be an optical sensor configured to detect when a user is on the user platform 30 and when a user leaves the user platform 30. Other types of sensors may be utilized, also. Embodiments of the present invention are not limited to optical sensors. The sensor 360 may be used to activate a display and/or lights, as described above. In addition, the sensor 360 may be used to activate a water flush system 350 (FIG. 10). For example, upon detecting that a user is no longer on the user platform 30, the sensor may activate the water flush system 350 to flush the urinal with water via one or more nozzles 352 positioned in or near an upper portion of the rear wall inner surface 314.

FIG. 11 illustrates a plurality of the urinals 300 of FIG. 9 in side-by-side, contacting arrangement within a restroom. In FIG. 11, the urinal sidewalls 320 and the user access ramp sidewalls 342 of adjacent urinals 300 are in contacting relationship, as illustrated. However, in other embodiments, the urinals 300 may be in adjacent, closely-spaced, non-contacting arrangement.

Figure 12:
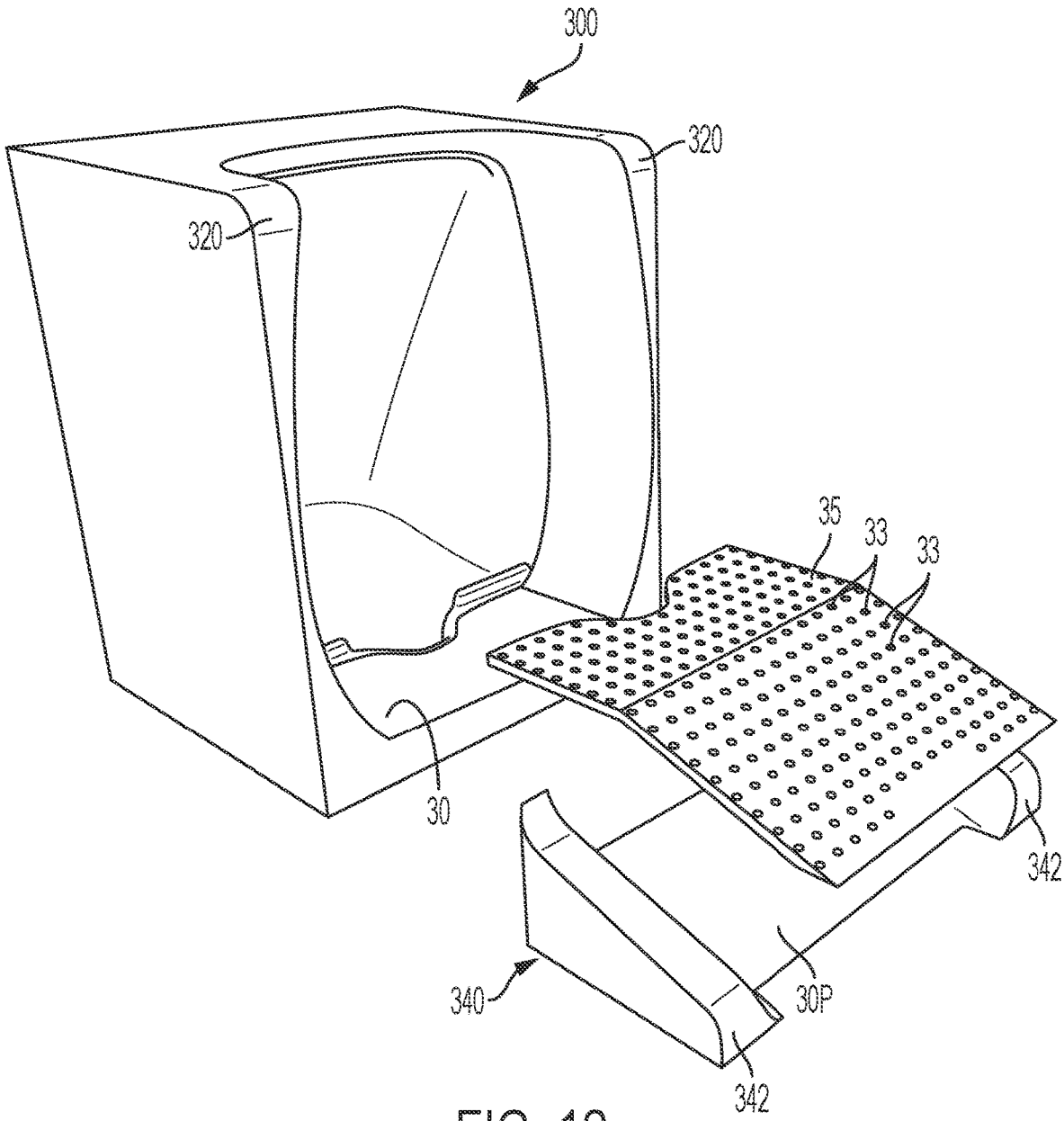
FIG. 12 is an exploded perspective view of the urinal of FIG. 9.
Figure 13:
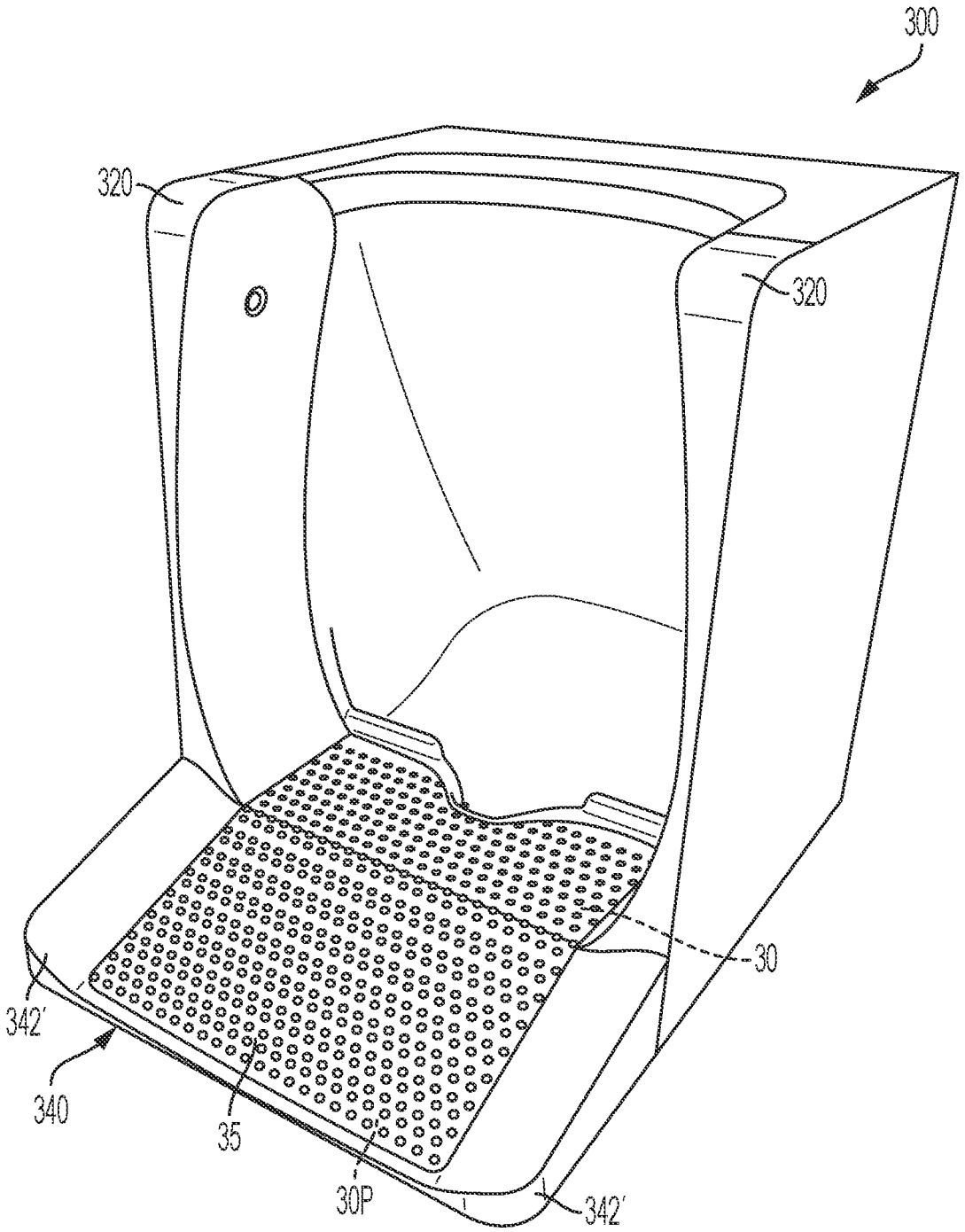
FIG. 13 is a front perspective view of the urinal of FIG. 9 with a different user access ramp, according to some embodiments of the present invention.

FIG. 12 is an exploded perspective view of the urinal 300 and user access ramp 340 of FIG. 9. In some embodiments, the user access ramp 340 can be attached to the urinal 300. In other embodiments, the user access ramp 340 and urinal are a monolithic structure, for example, formed together via injection molding. In some embodiments, the mat 35 is removably secured to the user platform 30 and ramp platform 30*p*, and can be removed and replaced when worn. The mat 35 may have various numbers and configurations of raised elements 33 to prevent a user from slipping when using the urinal FIG. 13 is a front perspective view of the urinal of FIG. 9 with a different user access ramp 340. In the illustrated embodiment of FIG. 13, the user access ramp sidewalls 342' have a different shape than the ramp sidewalls 342 in FIG. 9. In addition, the mat 35 is recessed within the ramp platform 30*p*, as illustrated. Embodiments of the present invention may utilize user access ramps having various shapes and configurations and mats of various shapes and configurations.

Figure 14:
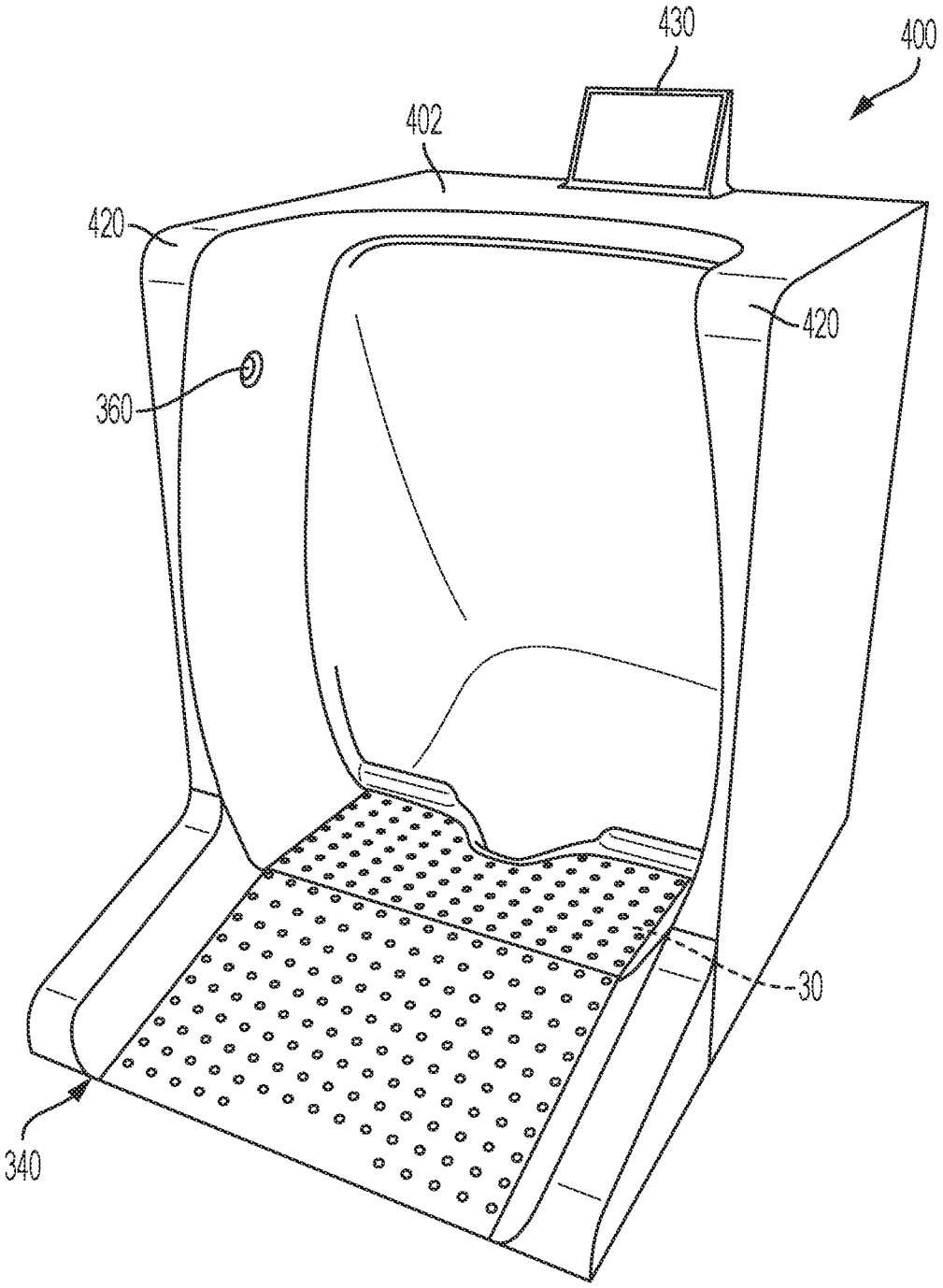
FIG. 14 is a front perspective view of a urinal, according to some embodiments of the present invention.
Figure 15:
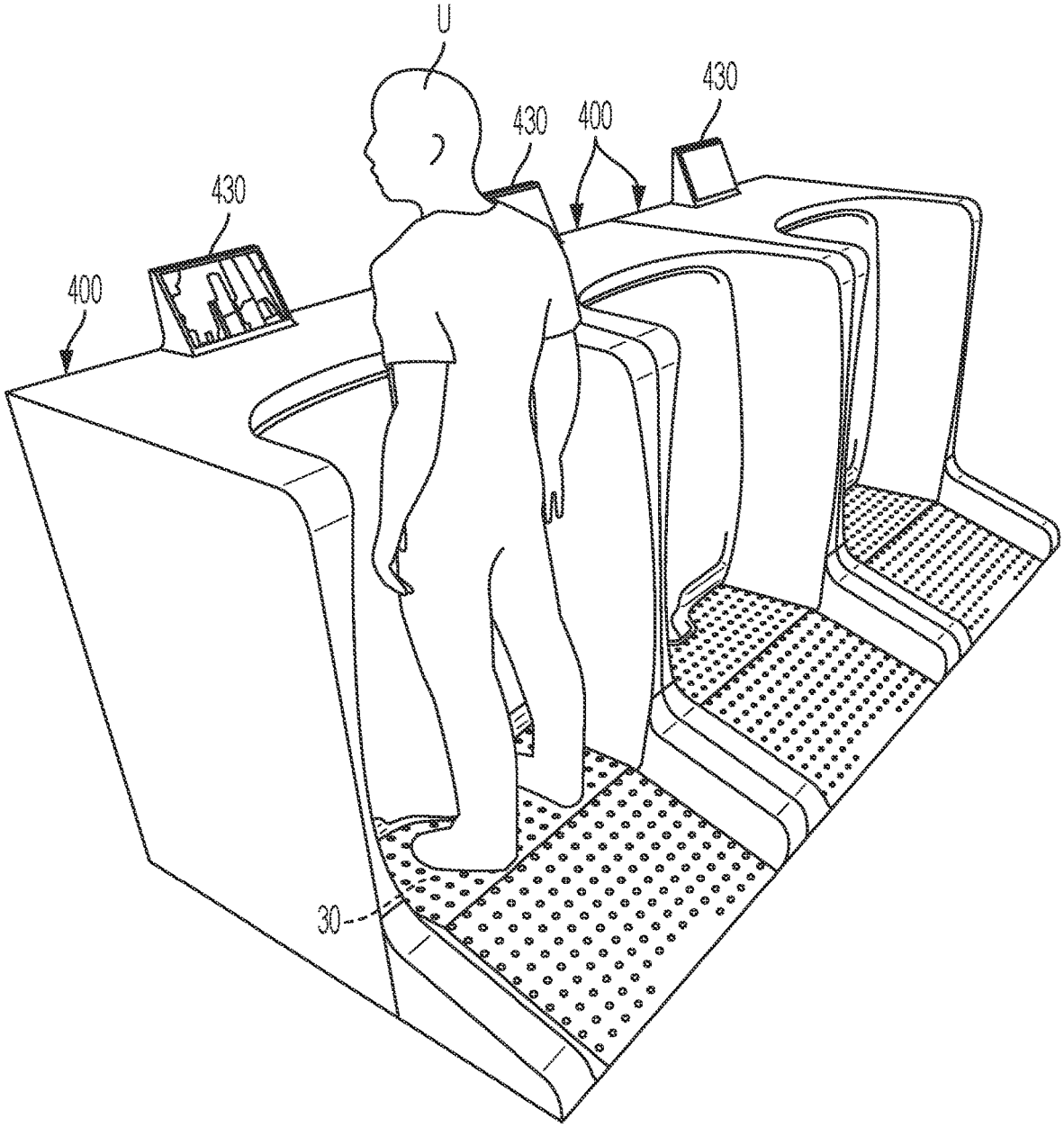
FIG. 15 illustrates a plurality of the urinals of FIG. 14 in side-by-side arrangement.

FIG. 14 is a front perspective view of a urinal 400, according to some embodiments of the present invention. The urinal is similar to the urinal 300 of FIG. 9, but includes a display 430 extending from an upper surface 401 of the urinal 400. The display 430 may be activated when the sensor 360 detects a user U on the user platform 30. For example, in FIG. 15, the user display 430 of the urinal with the user U has been activated as a result of the presence of the user U and is displaying information to the user U, while the displays 430 of the other urinals are not activated.

In the various embodiments described above, a water flushing system (e.g., water flushing system 350 in FIG. 10) may provide flushing water continuously, intermittently, or may be activated by a sensor, as described above. In some embodiments, the water flushing system 350 is configured to provide a reduced amount of water per flush, as compared with conventional urinals. For example, in some embodiments, the water flushing system 350 may provide about 0.25 gallons per flush.

Urinals 10, 100, 200, 300, 400 according to embodiments of the present invention, can work with various types of flushing systems without limitation. For example, urinals 10 according to embodiments of the present invention, can be configured to work with both water flushing systems and waterless flushing systems. Moreover, urinals 10, 100, 200, 300, 400 according to embodiments of the present invention, can be configured to work with various flushing activation systems, including manual activation systems and touchless activation systems, such as via a sensor.

Urinals 10, 100, 200, 300, 400 according to some embodiments of the present invention can be configured to facilitate automated cleaning. For example, various positions within a urinal 10, 100, 200, 300, 400 can serve as geometric reference points. By incorporating NFC tags and/or RFID tags at various locations of the rear wall, sidewalls, and/or user platform of the various urinals described above, a robotic cleaning device having a touch probe or vision system could utilize these reference points to clean the urinal quickly and accurately. In addition, such tags may facilitate the generation of unit-based cleaning records, as well as unit-based data exchange.

Urinals 10, 100, 200, 300, 400 according to some embodiments of the present invention can be configured to include various chemical analysis technologies for analyzing urine. For example, the urine of a person using a urinal 10, 100, 200, 300, 400 can be immediately analyzed for drugs, diabetes, alcohol, diseases, etc. For example, in some embodiments, facial recognition technology can be utilized to detect drug abuse, level of intoxication, etc. One or more facial recognition sensors can be positioned at various locations of the urinals 10, 100, 200, 300, 400.

Figure 16:
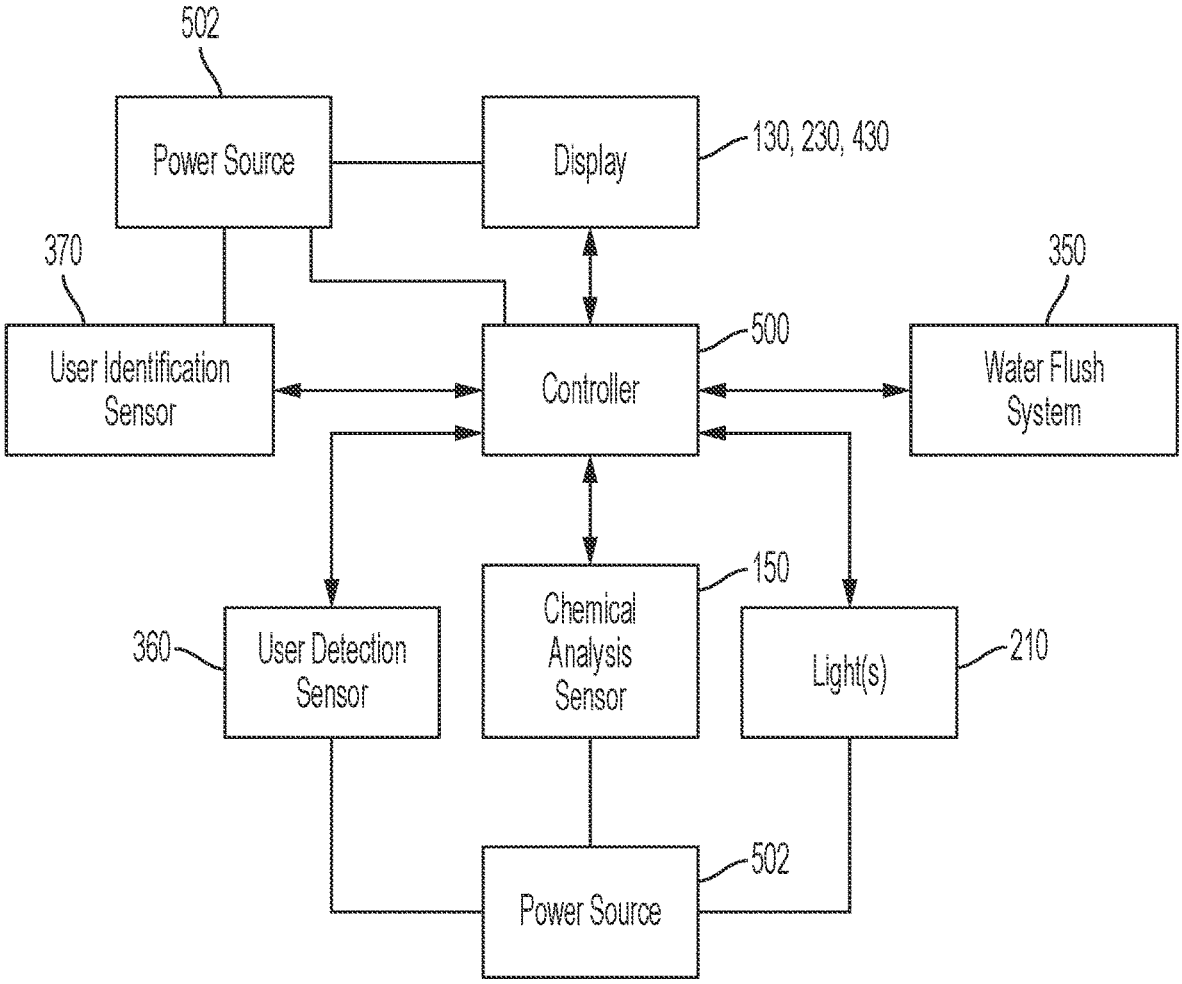
FIG. 16 is a schematic illustration of various electronic components and sensors that may be utilized by urinals, according to some embodiments of the present invention.

Referring to FIG. 16, each of the urinals 10, 100, 200, 300, 400 described above may include a controller 500 that is configured to control operation of the various electronic components (e.g., sensors, lights, displays, etc.) that the urinal may have. For example, the controller 500 may receive a signal from a user detection sensor 360 that a user is present. The controller may then activate one or more lights 210 associated with the urinal and/or a display 130, 230, 430 associated with the urinal while the user is present. In response to receiving a signal from the user detection sensor 360 that a user is no longer present, the controller 500 may be configured to deactivate the light(s) 210 and/or display 130, 230, 430. In addition, the controller 500 may be configured to activate a water flush system 350 in response to receiving a signal from a user detection sensor 360 that a user is present and/or receiving a signal from the user detection sensor 360 that a user is no longer present.

In embodiments where a chemical analysis sensor 150 is present, the controller 500 is configured to receive signals from the chemical analysis sensor 150 and process the signals using one or more chemical analysis algorithms. The controller 500 can display the results of such analysis on the display 130, 230, 430.

In embodiments where a user identification sensor 370 is present, the controller 500 is configured to receive signals from the user identification sensor 370 and process the signals to detect an identification of a user via one or more identification algorithms, and/or detect a level of intoxication of a user.

In addition, the controller 500 may be configured to generate and display on the display 130, 230, 430 various alerts or notifications, as well as other information.

The electronics of the urinals 10, 100, 200, 300, 400 are powered by one or more power sources 502. Exemplary power sources may include a battery and/or an external power source, such as an external AC or DC power source.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A urinal, comprising:

a rear wall having a concave inner surface extending downward toward a basin having a drain orifice therein;

a pair of sidewalls extending outwardly from the rear wall inner surface in spaced apart relationship, wherein the rear wall inner surface and an inner surface of each of the sidewalls define an internal space;

a user platform positioned within the internal space and elevated relative to the basin, wherein the sidewalls are configured such that, when a user is standing on the platform, the user is positioned within the internal space with each sidewall directly adjacent a respective side of the user; and a user access ramp extending from the user platform to a surface on which the urinal is supported, wherein the user access ramp comprises a ramp platform that connects with the user platform to form a substantially continuous surface upon which the user accesses and uses the urinal.

2. The urinal of claim 1, wherein the sidewalls have opposing concave inner surfaces.

3. The urinal of claim 1, wherein the user platform is angled downwardly toward the basin.

4. The urinal of claim 1, wherein the user platform comprises at least one raised feature adjacent an inner edge of the user platform, the at least one raised feature having a height of between about one-half inch to about three inches (½"-3").

5. The urinal of claim 1, wherein the user platform comprises a slip-resistant surface or a slip-resistant mat on a surface of the user platform.

6. The urinal of claim 5, wherein the slip-resistant surface comprises a plurality of raised features or wherein the slip-resistant mat comprises a plurality of raised features.

7. The urinal of claim 1, wherein at least a portion of the rear wall inner surface comprises a splash-resistant material, and wherein at least a portion of an inner surface of each of the sidewalls comprises the splash-resistant material.

8. The urinal of claim 1, wherein each sidewall has a respective upper end portion, and wherein the upper end portions of the sidewalls are spaced apart between about thirty-two inches and thirty-six inches (32"-36").

9. The urinal of claim 1, further comprising a substantially horizontal upper wall extending outwardly from the rear wall inner surface between upper end portions of the sidewalls.

10. The urinal of claim 1, wherein the urinal is a monolithic structure of polymeric material.

11. The urinal of claim 1, further comprising a sensor configured to detect a user on the user platform.

12. The urinal of claim 11, further comprising a water flush system, and wherein the water flush system is configured to supply water to flush the urinal in response to the sensor detecting the user on the user platform or detecting the user leaving the user platform.

13. The urinal of claim 11, further comprising a display, and wherein the display is configured to display information in response to the sensor detecting the user on the user platform.

14. The urinal of claim 1, further comprising at least one light configured to illuminate an interior of the urinal.

15. The urinal of claim 1, further comprising a sensor configured to detect a user on the user platform, and at least one light configured to illuminate an interior of the urinal, wherein the at least one light is configured to be activated in response to the sensor detecting the user on the user platform.

16. The urinal of claim 1, further comprising at least one chemical analysis sensor configured to analyze urine received from the user and to detect the presence of at least one chemical in the urine received from a user.

17. The urinal of claim 16, further comprising a sensor configured to detect a user on the user platform.

18. The urinal of claim 17, further comprising a water flush system, and wherein the water flush system is configured to supply water to flush the urinal in response to the sensor detecting the user on the user platform or detecting the user leaving the user platform.

19. The urinal of claim 1, further comprising a facial recognition sensor configured to detect one or more of the following: an identity of the user on the user platform, a level of intoxication of the user, drug abuse by the user.

20. A urinal, comprising:

a rear wall having a concave inner surface extending downward toward a basin having a drain orifice therein;

a pair of sidewalls extending outwardly from the rear wall inner surface in spaced apart relationship, and wherein the rear wall inner surface and inner surfaces of the sidewalls define an internal space; and a user platform positioned within the internal space, wherein the platform comprises a surface upon which a user stands that is elevated relative to the basin, and at least one raised feature extending upwardly from the user platform surface adjacent an inner edge of the user platform, wherein the at least one raised feature is configured to help prevent a foot of the user from slipping into the basin, wherein the sidewalls are configured such that, when a user is standing on the platform, the user is positioned within the internal space with each sidewall directly adjacent a respective side of the user.

21. The urinal of claim 20, wherein the user platform is angled downwardly, and the at least one raised feature has a height of between about one-half inch to about three inches (½"-3").

22. The urinal of claim 20, wherein the user platform comprises a slip-resistant surface or a slip-resistant mat on a surface of the user platform, wherein the slip-resistant surface comprises a plurality of raised features or wherein the slip-resistant mat comprises a plurality of raised features.

23. The urinal of claim 20, wherein at least a portion of the rear wall inner surface comprises a splash-resistant material, and wherein at least a portion of an inner surface of each of the sidewalls comprises the splash-resistant material.

24. The urinal of claim 20, further comprising a user access ramp extending from the user platform to a surface on which the urinal is supported, wherein the user access ramp comprises a ramp platform that connects with the user platform to form a substantially continuous surface upon which the user accesses and uses the urinal.

25. The urinal of claim 24, wherein the urinal is a monolithic structure of polymeric material.

26. The urinal of claim 20, further comprising at least one light configured to illuminate an interior of the urinal.

27. The urinal of claim 26, further comprising a sensor configured to detect a user on the user platform, and at least one light configured to illuminate an interior of the urinal, wherein the at least one light is configured to be activated in response to the sensor detecting the user on the user platform.

28. A restroom, comprising:

a plurality of urinals in adjacent relationship, wherein each urinal is a monolithic structure of polymeric material and comprises:

a rear wall having a concave inner surface extending downward toward a basin having a drain orifice therein;

a pair of sidewalls extending outwardly from the rear wall inner surface in spaced apart relationship, and wherein the rear wall inner surface and inner surfaces of the sidewalls define an internal space; and a user platform positioned within the internal space, wherein the platform comprises a surface that is elevated relative to the basin, and at least one raised feature extending upwardly from the user platform surface adjacent an inner edge of the user platform, wherein the at least one raised feature is configured to help prevent a foot of the user from slipping into the basin, wherein the sidewalls are configured such that, when a user is standing on the platform, the user is positioned within the internal space with each sidewall directly adjacent a respective side of the user.

29. The restroom of claim 28, wherein the user platform of each urinal comprises:

a slip-resistant surface or a slip-resistant mat on the surface of the user platform.

30. The restroom of claim 28, wherein at least one of the urinals comprises a user access ramp extending from a respective user platform of the at least one urinal to a surface on which the at least one urinal is supported, wherein the user access ramp comprises a ramp platform that connects with the user platform to form a substantially continuous surface upon which the user accesses and uses the urinal.

31. The restroom of claim 28, wherein at least one of the urinals comprises a sensor configured to detect a user on a respective user platform of the at least one urinal, and at least one light configured to illuminate an interior of the at least one urinal, wherein the at least one light is configured to be activated in response to the sensor detecting the user on the user platform.

32. The restroom of claim 28, wherein at least one of the urinals comprises a sensor configured to detect a user on a respective user platform of the at least one urinal, and a display configured to display information in response to the sensor detecting the user on the user platform.

33. The restroom of claim 28, wherein the plurality of urinals are in adjacent contacting relationship.

* * * * *